US010475406B2

(12) United States Patent
Kim et al.

(10) Patent No.: US 10,475,406 B2
(45) Date of Patent: Nov. 12, 2019

(54) DISPLAY PANEL HAVING ZIGZAG CONNECTION STRUCTURE AND DISPLAY DEVICE INCLUDING THE SAME

(71) Applicant: Samsung Electronics Co., Ltd., Suwon-si, Gyeonggi-do (KR)

(72) Inventors: Jeong-Pyo Kim, Seoul (KR); Ki-Ho Kong, Suwon-si (KR); Young-Bae Moon, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 15/833,380

(22) Filed: Dec. 6, 2017

(65) Prior Publication Data

US 2018/0342217 A1 Nov. 29, 2018

(30) Foreign Application Priority Data

May 24, 2017 (KR) ..... 10-2017-0063947

(51) Int. Cl.
*G09G 3/36* (2006.01)

(52) U.S. Cl.
CPC ..... *G09G 3/3648* (2013.01); *G09G 3/3688* (2013.01); *G09G 2300/0421* (2013.01); *G09G 2300/0426* (2013.01); *G09G 2300/0439* (2013.01); *G09G 2300/0452* (2013.01); *G09G 2310/0291* (2013.01); *G09G 2310/0294* (2013.01); *G09G 2310/0297* (2013.01)

(58) Field of Classification Search
CPC ..... G09G 3/3648
See application file for complete search history.

(56) References Cited

U.S. PATENT DOCUMENTS

| | | | | |
|---|---|---|---|---|
| 8,154,495 | B2 | 4/2012 | Hsu | |
| 8,466,867 | B2 | 6/2013 | Jarupoonphol et al. | |
| 8,487,857 | B2 | 7/2013 | Kim et al. | |
| 8,619,008 | B2 | 12/2013 | Cok | |
| 9,171,517 | B2 | 10/2015 | Shibata et al. | |
| 2004/0113923 | A1* | 6/2004 | Ha | G09G 3/3208 345/690 |

(Continued)

FOREIGN PATENT DOCUMENTS

| | | | |
|---|---|---|---|
| JP | 5809983 | B2 | 9/2005 |
| JP | 5378592 | B2 | 10/2013 |

(Continued)

*Primary Examiner* — Carolyn R Edwards
(74) *Attorney, Agent, or Firm* — Harness, Dickey & Pierce, P.L.C.

(57) ABSTRACT

A display device including a display panel and a driving circuit configured to drive the display panel may be provided. The display panel includes a plurality of gate lines, a plurality of data lines and a plurality of sub pixels connected to the plurality of gate lines and the plurality of data lines, respectively. The display panel has a zigzag connection structure in which RG sub pixel pairs included in a first odd-numbered row and RG sub pixel pairs included in a first even-numbered row adjacent to the first odd-numbered row are alternately connected to a first common gate line, and BG sub pixel pairs included in a second odd-numbered row and BG sub pixel pairs included in a second even-numbered row adjacent to the second odd-numbered row are alternately connected to a second common gate line.

20 Claims, 21 Drawing Sheets

(56) References Cited

U.S. PATENT DOCUMENTS

| | | | | |
|---|---|---|---|---|
| 2004/0246404 | A1* | 12/2004 | Elliott | G02F 1/1368 349/88 |
| 2012/0235965 | A1 | 9/2012 | Pai | |
| 2012/0327137 | A1* | 12/2012 | Saitoh | G09G 3/3648 345/690 |
| 2014/0320478 | A1 | 10/2014 | Oh et al. | |
| 2015/0187308 | A1* | 7/2015 | Shin | G09G 3/3614 345/209 |
| 2015/0348481 | A1* | 12/2015 | Hong | G09G 3/2003 345/690 |
| 2015/0379920 | A1* | 12/2015 | Yang | G09G 3/3648 345/214 |
| 2016/0042695 | A1 | 2/2016 | Park et al. | |
| 2016/0155401 | A1 | 6/2016 | Lee et al. | |
| 2016/0189641 | A1 | 6/2016 | Son et al. | |
| 2016/0202583 | A1 | 7/2016 | Jung et al. | |
| 2016/0203776 | A1 | 7/2016 | Choo et al. | |
| 2017/0169756 | A1 | 6/2017 | Kim et al. | |
| 2017/0229097 | A1 | 8/2017 | Nakanishi et al. | |

FOREIGN PATENT DOCUMENTS

| | | | |
|---|---|---|---|
| JP | 2016024380 | A | 7/2014 |
| KR | 20160019598 | A | 2/2016 |
| KR | 10-20160083325 | A | 7/2016 |
| KR | 10-20160086504 | A | 7/2016 |
| KR | 1670514 | B1 | 10/2016 |

* cited by examiner

FIG. 7A

HP1

| | | | | | | | |
|---|---|---|---|---|---|---|---|
| R11 | G12 | B13 | G14 | R15 | G16 | B17 | G18 |
| B21 | G22 | R23 | G24 | B25 | G26 | R27 | G28 |
| R31 | G32 | B33 | G34 | R35 | G36 | B37 | G38 |
| B41 | G42 | R43 | G44 | B45 | G46 | R47 | G48 |
| R51 | G52 | B53 | G54 | R55 | G56 | B57 | G58 |
| B61 | G62 | R63 | G64 | B65 | G66 | R67 | G68 |

FIG. 7B

HP2

| | | | | | | | |
|---|---|---|---|---|---|---|---|
| R11 | G12 | B13 | G14 | R15 | G16 | B17 | G18 |
| B21 | G22 | R23 | G24 | B25 | G26 | R27 | G28 |
| R31 | G32 | B33 | G34 | R35 | G36 | B37 | G38 |
| B41 | G42 | R43 | G44 | B45 | G46 | R47 | G48 |
| R51 | G52 | B53 | G54 | R55 | G56 | B57 | G58 |
| B61 | G62 | R63 | G64 | B65 | G66 | R67 | G68 |

FIG. 7C

HP3

| | | | | | | | |
|---|---|---|---|---|---|---|---|
| R11 | G12 | B13 | G14 | R15 | G16 | B17 | G18 |
| B21 | G22 | R23 | G24 | B25 | G26 | R27 | G28 |
| R31 | G32 | B33 | G34 | R35 | G36 | B37 | G38 |
| B41 | G42 | R43 | G44 | B45 | G46 | R47 | G48 |
| R51 | G52 | B53 | G54 | R55 | G56 | B57 | G58 |
| B61 | G62 | R63 | G64 | B65 | G66 | R67 | G68 |

FIG. 8

FP

| | | | | | | | |
|---|---|---|---|---|---|---|---|
| R11 | G12 | B13 | G14 | R15 | G16 | B17 | G18 |
| B21 | G22 | R23 | G24 | B25 | G26 | R27 | G28 |
| R31 | G32 | B33 | G34 | R35 | G36 | B37 | G38 |
| B41 | G42 | R43 | G44 | B45 | G46 | R47 | G48 |
| R51 | G52 | B53 | G54 | R55 | G56 | B57 | G58 |
| B61 | G62 | R63 | G64 | B65 | G66 | R67 | G68 |

FIG. 12A

HP1 OF FP(N)

| | | | | | | | |
|---|---|---|---|---|---|---|---|
| R11 | G12 | B13 | G14 | R15 | G16 | B17 | G18 |
| B21 | G22 | R23 | G24 | B25 | G26 | R27 | G28 |
| R31 | G32 | B33 | G34 | R35 | G36 | B37 | G38 |
| B41 | G42 | R43 | G44 | B45 | G46 | R47 | G48 |
| R51 | G52 | B53 | G54 | R55 | G56 | B57 | G58 |
| B61 | G62 | R63 | G64 | B65 | G66 | R67 | G68 |

FIG. 12B

HP2 OF FP(N)

| | | | | | | | |
|---|---|---|---|---|---|---|---|
| R11 | G12 | B13 | G14 | R15 | G16 | B17 | G18 |
| B21 | G22 | R23 | G24 | B25 | G26 | R27 | G28 |
| R31 | G32 | B33 | G34 | R35 | G36 | B37 | G38 |
| B41 | G42 | R43 | G44 | B45 | G46 | R47 | G48 |
| R51 | G52 | B53 | G54 | R55 | G56 | B57 | G58 |
| B61 | G62 | R63 | G64 | B65 | G66 | R67 | G68 |

FIG. 12C

FP(N)

| | | | | | | | |
|---|---|---|---|---|---|---|---|
| R11 | G12 | B13 | G14 | R15 | G16 | B17 | G18 |
| B21 | G22 | R23 | G24 | B25 | G26 | R27 | G28 |
| R31 | G32 | B33 | G34 | R35 | G36 | B37 | G38 |
| B41 | G42 | R43 | G44 | B45 | G46 | R47 | G48 |
| R51 | G52 | B53 | G54 | R55 | G56 | B57 | G58 |
| B61 | G62 | R63 | G64 | B65 | G66 | R67 | G68 |

FIG. 14A

HP1 OF FP(N+1)

| | | | | | | | |
|---|---|---|---|---|---|---|---|
| R11 | G12 | B13 | G14 | R15 | G16 | B17 | G18 |
| B21 | G22 | R23 | G24 | B25 | G26 | R27 | G28 |
| R31 | G32 | B33 | G34 | R35 | G36 | B37 | G38 |
| B41 | G42 | R43 | G44 | B45 | G46 | R47 | G48 |
| R51 | G52 | B53 | G54 | R55 | G56 | B57 | G58 |
| B61 | G62 | R63 | G64 | B65 | G66 | R67 | G68 |

FIG. 14B

HP2 OF FP(N+1)

| | | | | | | | |
|---|---|---|---|---|---|---|---|
| R11 | G12 | B13 | G14 | R15 | G16 | B17 | G18 |
| B21 | G22 | R23 | G24 | B25 | G26 | R27 | G28 |
| R31 | G32 | B33 | G34 | R35 | G36 | B37 | G38 |
| B41 | G42 | R43 | G44 | B45 | G46 | R47 | G48 |
| R51 | G52 | B53 | G54 | R55 | G56 | B57 | G58 |
| B61 | G62 | R63 | G64 | B65 | G66 | R67 | G68 |

FIG. 14C

FP(N+1)

| | | | | | | | |
|---|---|---|---|---|---|---|---|
| R11 | G12 | B13 | G14 | R15 | G16 | B17 | G18 |
| B21 | G22 | R23 | G24 | B25 | G26 | R27 | G28 |
| R31 | G32 | B33 | G34 | R35 | G36 | B37 | G38 |
| B41 | G42 | R43 | G44 | B45 | G46 | R47 | G48 |
| R51 | G52 | B53 | G54 | R55 | G56 | B57 | G58 |
| B61 | G62 | R63 | G64 | B65 | G66 | R67 | G68 |

DISPLAY PANEL HAVING ZIGZAG CONNECTION STRUCTURE AND DISPLAY DEVICE INCLUDING THE SAME

CROSS-REFERENCE TO RELATED APPLICATION

This U.S. Non-provisional application claims priority under 35 USC § 119 to Korean Patent Application No. 10-2017-0063947, filed on May 24, 2017, in the Korean Intellectual Property Office (KIPO), the disclosure of which is incorporated by reference in its entirety herein.

BACKGROUND

1. Technical Field

Some example embodiments relate to semiconductor integrated circuits, and more particularly to display panels having a zigzag connection structure and/or display devices including the same.

2. Discussion of Related Art

Power consumption of a display device may increase as size and/or resolution of a display panel included in the display device increase. The power consumption of the display device may include static power consumed by circuits for driving the display panel and dynamic power consumed by pixels included in the display panel. The static and dynamic power consumption may increase depending on configuration of the display device, input frame data, etc. Further, occupation area for driving the display panel may increase as the size and the resolution of the display panel increase.

SUMMARY

Some example embodiments may provide display panels capable of reducing power consumption.

Some example embodiments may provide display devices including display panels capable of reducing power consumption.

Some example embodiments may provide methods of operating display devices capable of reducing power consumption.

According to an example embodiment, a displace device includes a display panel including a plurality of gate lines, a plurality of data lines and a plurality of sub pixels connected to the plurality of gate lines and the plurality of data lines, respectively, the display panel having a zigzag connection structure in which RG sub pixel pairs included in a first odd-numbered row and RG sub pixel pairs included in a first even-numbered row adjacent to the first odd-numbered row are alternately connected to a first common gate line in a row direction, and BG sub pixel pairs included in a second odd-numbered row and BG sub pixel pairs included in a second even-numbered row adjacent to the second odd-numbered row are alternately connected to a second common gate line in the row direction, and a driving circuit configured to drive the display panel.

According to an example embodiments, a display panel includes a plurality of gate lines extending in a row direction, a plurality of data lines extending in a column direction, a plurality of sub pixels connected to the plurality of gate lines and the plurality of data lines, respectively, in a zigzag connection structure such that RG sub pixel pairs included in a first odd-numbered row and RG sub pixel pairs included in a first even-numbered row adjacent to the first odd-numbered row are alternately connected to a first common gate line, and BG sub pixel pairs included in a second odd-numbered row and BG sub pixel pairs included in a second even-numbered row adjacent to the second odd-numbered row are alternately connected to a second common gate line.

According to an example embodiments, a display panel includes a plurality of gate lines extending in a row direction, a plurality of data lines extending in a column direction, and a plurality of sub pixels connected to the plurality of gate lines and the plurality of data lines, respectively, the plurality of sub pixels having a zigzag connection structure in which (1) a plurality of RG sub pixel pairs and a plurality of BG sub pixel pairs are alternately arranged both in a row direction and in a column direction, and (2) the plurality of RG sub pixel pairs included in a first row and the plurality of RG sub pixel pairs included in a second row immediately adjacent to the first row are connected to a first common gate line, and the plurality of BG sub pixel pairs included in a second row and the plurality of BG sub pixel pairs included in a third row immediately adjacent to the second row are connected to a second common gate line.

In a method of operating a display device according to some example embodiments of the present disclosure, an operation mode of a display device having a zigzag connection structure may include a normal operation mode and an interlace operation mode. In the normal operation mode, all of RG sub pixel pairs and BG sub pixel pairs may be driven during each frame period. In the interlace operation mode, one of the RG sub pixel pairs or the BG sub pixel pairs may be driven during one frame period of two adjacent frame periods and the other one of the RG sub pixel pairs or the BG sub pixel pairs may be driven during the other frame period of the two adjacent frame periods.

The display panel and the display device including the display panel according to some example embodiments of the present disclosure may reduce line flickering in a row direction and/or image degradation by interlace scanning through the zigzag connection structure in which sub pixels of the same color included in two adjacent rows are connected to the same gate line.

Further, the display panel and the display device including the display panel according to some example embodiments of the present disclosure may perform an interlace operation and reduce dynamic power consumption through the zigzag connection structure.

Further, the display panel and the display device including the display panel according to some example embodiments of the present disclosure may reduce occupation area of the gamma voltage generation circuit and reduce static power consumption through the zigzag connection structure.

BRIEF DESCRIPTION OF THE DRAWINGS

Example embodiments of the present disclosure will be more clearly understood from the following detailed description taken in conjunction with the accompanying drawings.

FIGS. 7A, 7B, 7C, and 8 are diagrams for describing sequence of display data applied to a display panel in the normal operation mode of FIG. 6.

FIGS. 12A, 12B, and 12C are diagrams for describing sequence of display data applied to a display panel during the N-th frame period in the interlace operation mode of FIG. 11.

FIGS. 14A, 14B, and 14C are diagrams for describing sequence of display data applied to a display panel during the (N+1)-th frame period in the interlace operation mode of FIG. 13.

DETAILED DESCRIPTION

Figure 1:
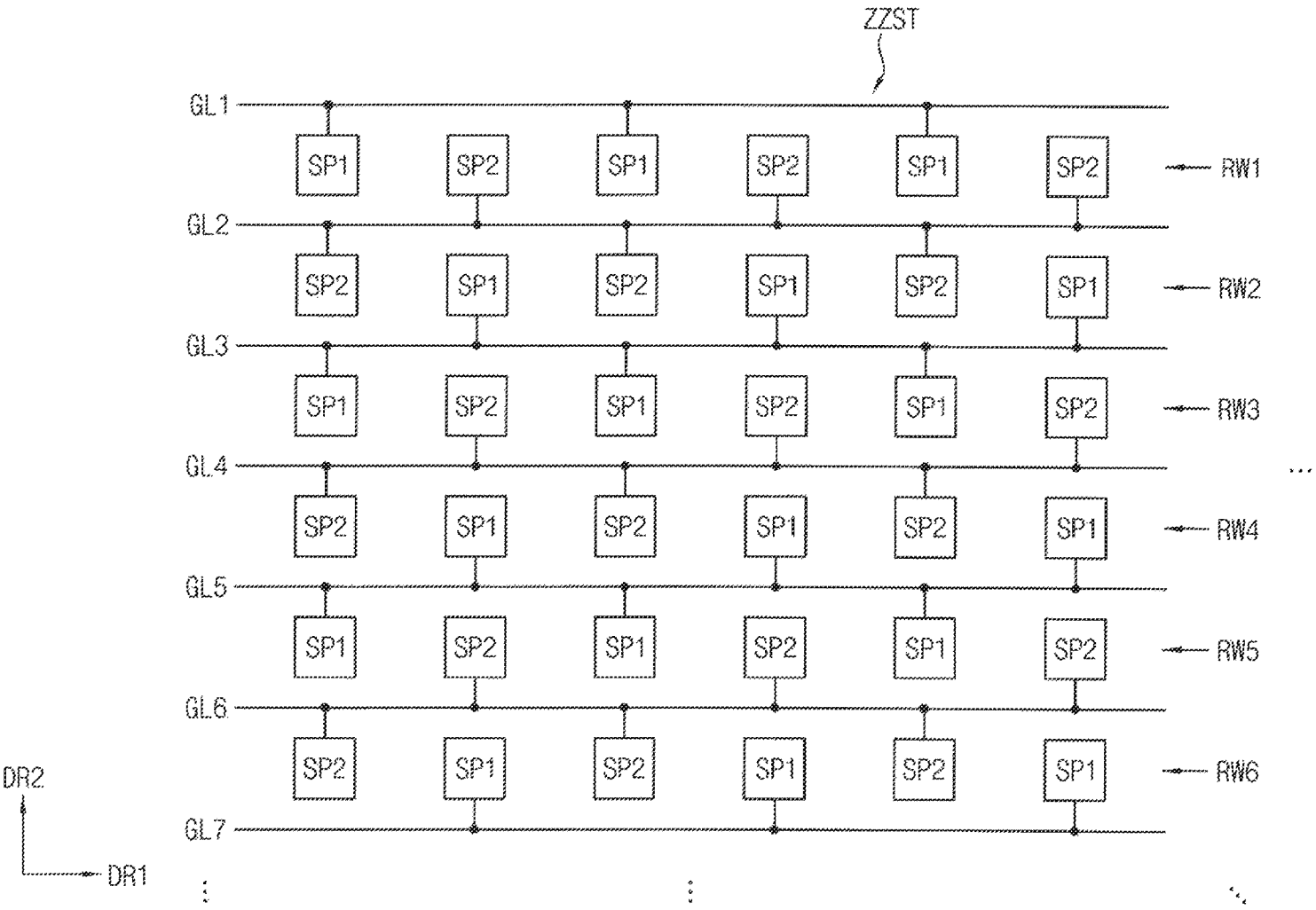
FIG. 1 is a diagram illustrating a zigzag connection structure of a display panel according to an example embodiment.

Various example embodiments will be described more fully hereinafter with reference to the accompanying drawings, in which some example embodiments are shown. In the drawings, like numerals refer to like elements throughout. The repeated descriptions may be omitted.

In this disclosure, a zigzag connection structure ZZST may include a structure in which sub pixels of a particular color are connected to ones of odd-numbered gate lines or even-numbered gate lines) and sub pixels of another color are connected to the other ones of even-numbered gate lines or odd-numbered gate lines.

FIG. 1 is a diagram illustrating a zigzag connection structure of a display panel according to an example embodiment.

Referring to FIG. 1, in a zigzag connection structure ZZST, sub pixels SP1 of a first color may be connected to odd-numbered gate lines GL1, GL3, GL5 and GL7 among a plurality of gate lines GL1~GL7, and sub pixels SP2 of a second color may be connected to even-numbered gate lines GL2, GL4 and GL6 among the plurality of gate lines GL1~GL7. One of the sub pixels SP1 of the first color and the sub pixels SP2 of the second color may be R (red) sub pixels, and the other of the sub pixels SP1 of the first color and the sub pixels SP2 may be B (blue) sub pixels. FIG. 1 illustrates the sub pixels in first through sixth rows RW1~RW6 for convenience of illustration, and the numbers of rows and columns of the sub pixels may vary depending on the resolution of the display panel. Data lines are omitted in FIG. 1 for convenience of illustration. Further, connection structure of the data lines and the sub pixels may vary.

A pixel or a pixel cluster may include a plurality of sub pixels of different colors. For example, one pixel may be a combination of at least two pixels among a R (red) sub pixel, a G (green) sub pixel, a B (blue) sub pixel, a W (white) sub pixel, etc. FIG. 1 illustrates only the sub pixels SP1 of the first color and the sub pixels SP2 of the second color for convenience of illustration, and the sub pixels of the other colors are omitted in FIG. 1. The omitted sub pixels of the other colors may be connected to the gate lines GL1~GL7 variously.

As illustrated in FIG. 1, the sub pixels SP1 of the first color and the sub pixels SP2 of the second color may be alternately arranged in a row direction DR1 and a column direction DR2. In this case, the sub pixels SP1 of the first color included in the odd-numbered row (e.g., the third row RW3) of the two adjacent rows (e.g., the second and third rows RW2 and RW3) and the sub pixels SP1 of the first color included in the even-numbered row (e.g., the second row RW2) of the two adjacent rows (e.g., the second and third rows RW2 and RW3) may be alternately connected in the same gate line (e.g., the third gate line GL3). Likewise, the sub pixels SP2 of the second color included in e odd-numbered row the first row RW1) of the two adjacent rows (e.g., the first and second rows RW1 and RW2) and the sub pixels SP2 of the second color included in the even-numbered row (e.g., the second row RW2) of the two adjacent rows (e.g., the first and second rows RW1 and RW2) may be alternately connected in the same gate line (e.g., the second gate line GL2).

Figure 4:
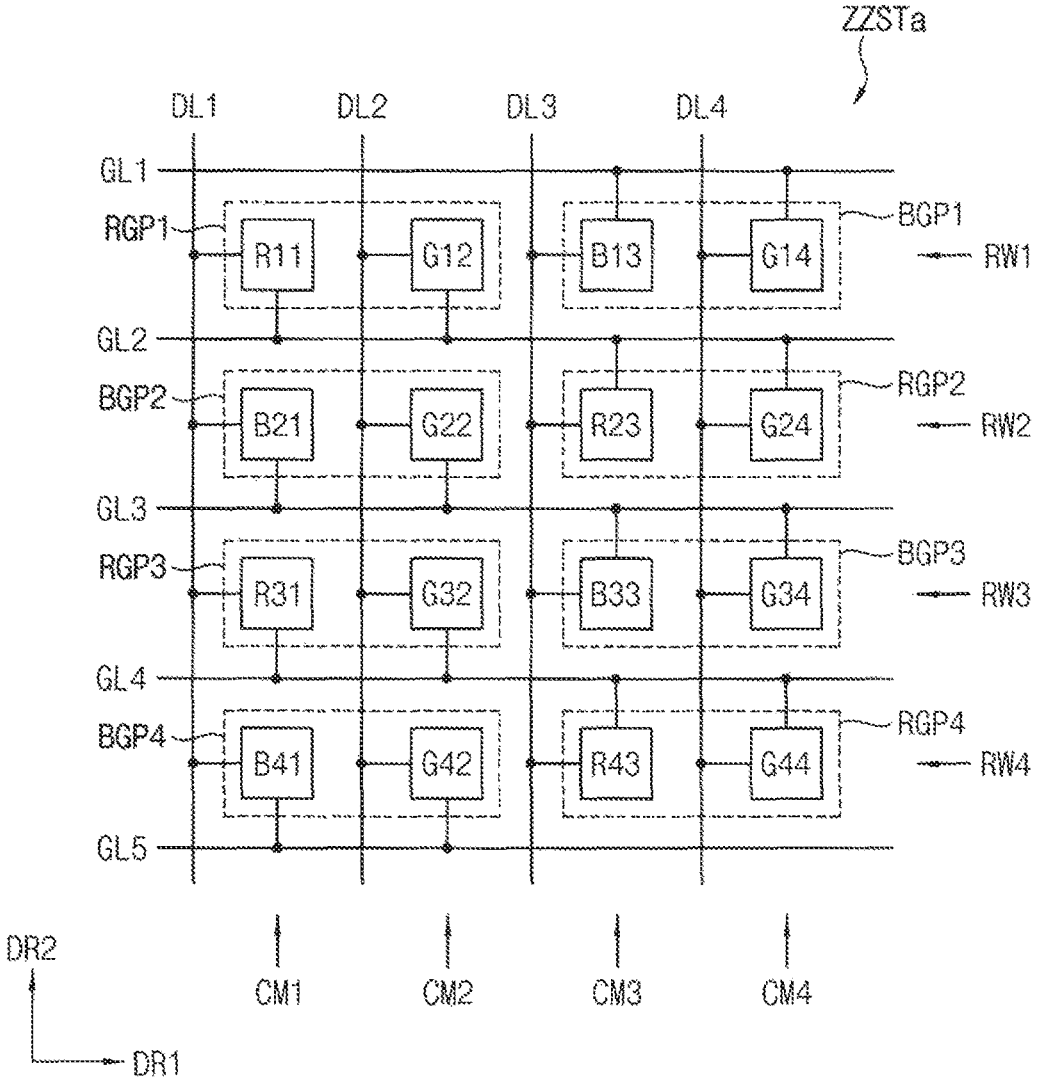
FIG. 4 is a diagram illustrating a zigzag connection structure of a display panel according to an example embodiment.

In some example embodiments, the display panel may have a zigzag connection structure in which RG sub pixel pairs included in an odd-numbered row of two adjacent rows and RG sub pixel pairs included in an even-numbered row of the two adjacent rows are alternately connected to a common gate line, and BG sub pixel pairs included in an odd-numbered row of two adjacent rows and BG sub pixel pairs included in an even-numbered row of the two adjacent rows are alternately connected to a common gate line, as illustrated in FIG. 4.

As described below, through such zigzag connection structure ZZST, line flickering in the row direction DR1 and image degradation by interlace scanning may be reduced. Also an interlace operation may be performed more efficiently, and dynamic power consumption may be reduced through the zigzag connection structure ZZST. Further occupation area of a gamma voltage generation circuit may be reduced and static power consumption may be reduced through the zigzag connection structure ZZST.

Figure 2:
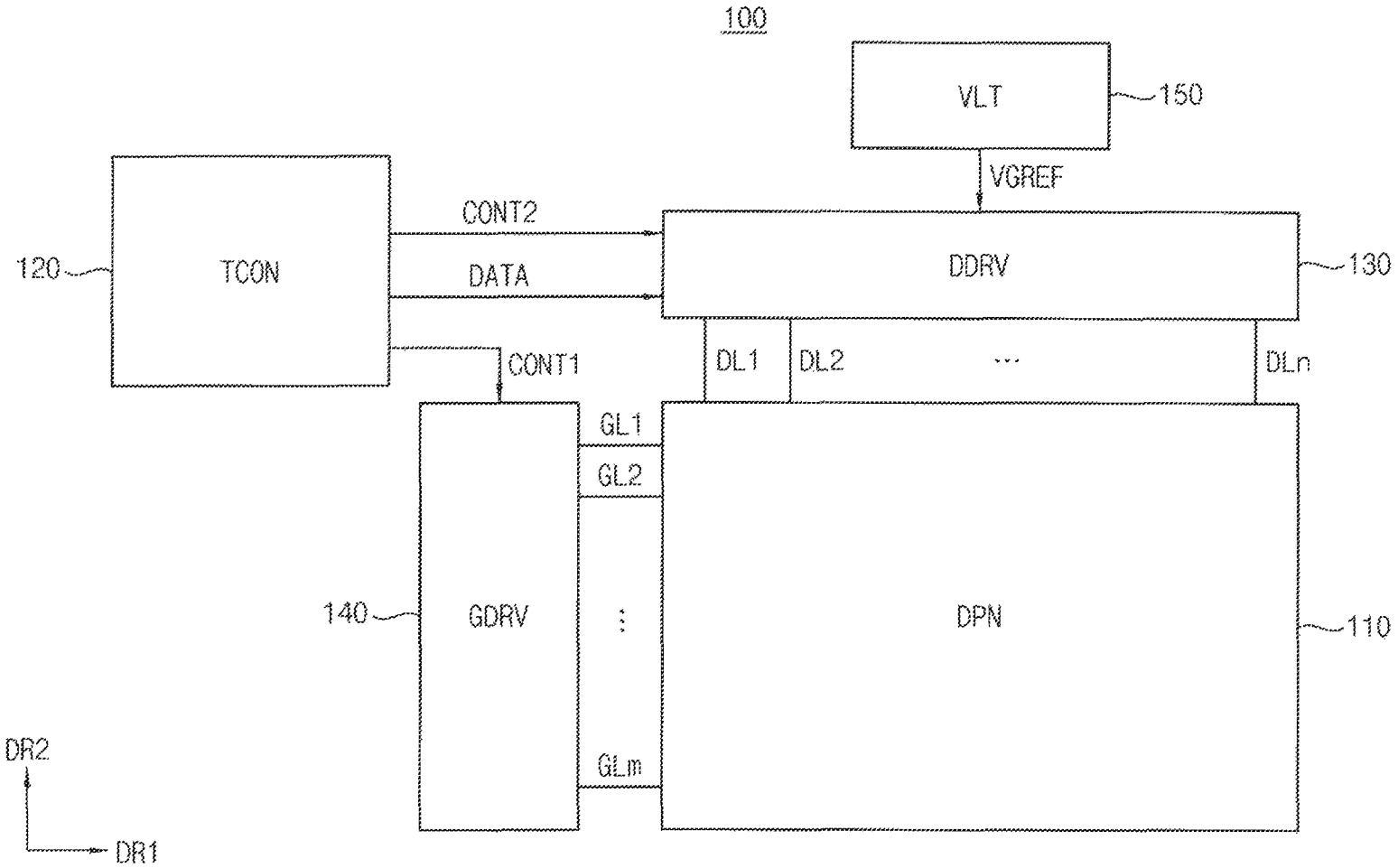
FIG. 2 is a block diagram illustrating a display device according to an example embodiment.
Figure 3A:
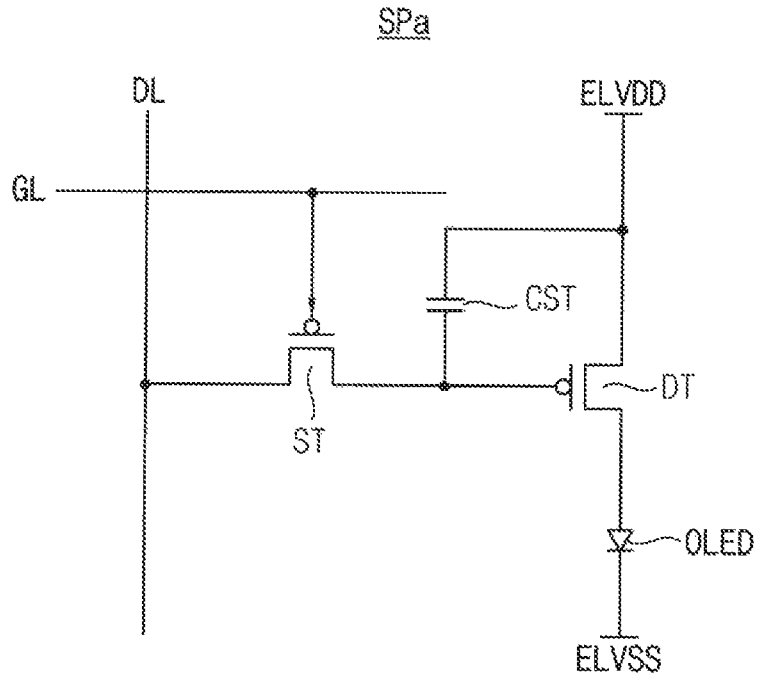
FIGS. 3A and 3B are circuit diagrams illustrating examples of sub pixels included in the display panel in FIG. 2.
Figure 3B:
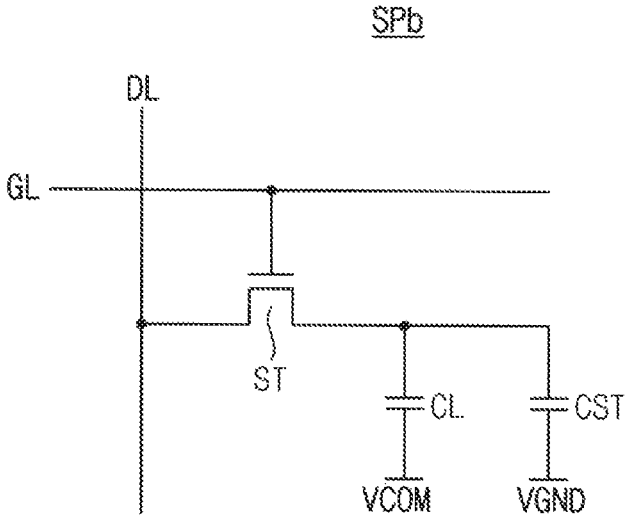

FIG. 2 is a block diagram illustrating a display device according to an example embodiment, and FIGS. 3A and 3B are circuit diagrams illustrating examples of sub pixels included in the display panel in FIG. 2.

Referring to FIG. 2, a display device 100 includes a display panel (DPN) 110 and a driving circuit. The driving circuit includes a timing controller (TCON) 120, a data driver circuit (DDRV) 130, a gate driver circuit (GDRV) 140, and a gamma voltage generation circuit (VLT) 150. Although not illustrated in FIG. 2, the display device 100 may further include other components such as a buffer for storing image data to be displayed and a back light unit.

The display panel 110 includes a plurality of gate lines GL1~GLm extending in a row direction DR1, a plurality of data lines DL1~DLn extending in a column direction DR2 perpendicular to the row direction DR1, and a plurality of sub pixels coupled to the plurality of data lines DL1~DLn and the plurality of gate lines GL1~GLm, respectively. For example, the plurality sub pixels may be arranged in a matrix form of m rows and n columns.

In some example embodiments, the display panel 110 in FIG. 2 may include electroluminescent sub pixels including an organic light emitting diode (OLED) as illustrated in FIG. 3A.

Referring to FIG. 3A, a sub pixel Spa may include a switching transistor ST, a storage capacitor CST, a driving transistor DT, and an OLED. The switching transistor ST has a first source/drain terminal connected to a data line DL or a source line, a second source/drain terminal connected to the storage capacitor CST, and a gate terminal connected to a gate line GL or a scan line. The switching transistor ST transfers a data signal received from the data driver circuit 130 to the storage capacitor CST in response to a gate driving signal received from the gate driver circuit 140. The storage capacitor CST has a first terminal connected to a high power supply voltage ELVDD and s second terminal connected to the driving transistor DT. The storage capacitor CST stores the data signal transferred through the switching transistor ST. The driving transistor DT has a first source/drain terminal connected to the high power supply voltage ELVDD, a second source/drain terminal connected to the OLED, and a gate terminal connected to the storage capacitor CST. The driving transistor DT can be turned on or off according to the data signal stored in the storage capacitor CST. The OLED has an anode electrode connected to the driving transistor DT and a cathode electrode connected to a low power supply voltage ELVSS. The OLED can emit light based on a current flowing from the high power supply voltage ELVDD to the low power supply voltage ELVSS while the driving transistor DT is turned on. This simple structure of each pixel, or a 2T1C structure including two transistors ST and DT and one capacitor CST is one example of a pixel structure that is suitable for a large sized display device.

The structure of the sub pixel Spa of FIG. 3A does not limit example embodiments of the display panel. Electroluminescent sub pixels of various configurations may be adopted to the display panel according to some example embodiments.

In some example embodiments, the display panel 110 in FIG. 2 may include liquid crystal display (LCD) sub pixels including liquid crystal capacitor as illustrated in FIG. 3B.

Referring to FIG. 3B, a sub pixel SPb may include a switching transistor ST, a liquid crystal capacitor CL and a storage capacitor CST. The switching transistor ST connects the capacitors CL and CST to a corresponding data line DL in response to a gate driving signal transferred through a corresponding gate line GL. The liquid crystal capacitor CL is connected between the switching transistor ST and the common voltage VCOM. The storage capacitor CST is connected between the switching transistor ST and a ground voltage VGND. The liquid crystal capacitor CL may adjust an amount of transmitted light depending on the data stored in the storage capacitor CST.

The structure of the sub pixel SPb of FIG. 3B does not limit example embodiments of the display panel. For example, LCS sub pixels of various configurations may be adopted to the display panel according to some example embodiments.

Referring back to FIG. 2, The sub pixels in the display panel 110 are connected to the data driver circuit 130 through the data lines DL1~DLn and to the gate driver circuit 140 through the gate lines GL1~GLm.

The data driver circuit 130 provides data signals to display panel 110 by providing data voltages through the data lines DL1~DLn. The gate driver circuit 140 provides gate driving signals through the gate lines GL1~GLm for controlling rows of sub pixels. The timing controller 120 controls overall operations of the display device 100. The timing controller 120 may provide control signals CONT1 and CONT2 to control the gate driver circuit 140 and the data driver circuit 130, respectively, to control the display panel 110. In an example embodiment, the timing controller 120, the data driver circuit 130 and the gate driver circuit 140 may be implemented as a single integrated circuit (IC). In another example embodiment, the timing controller 120, the data driver circuit 130 and the gate driver circuit 140 may be implemented as two or more ICs.

The gamma voltage generation circuit 150 generates gamma voltages VGREF and provides the gamma voltages VGREF to the data driver circuit 130. The gamma voltages VGREF have voltage levels corresponding to the display data DATA. For example, the gamma voltage generation circuit 150 may include a resistor string circuit such that a plurality of resistors are coupled in series between a power supply voltage and a ground voltage to provide divided voltages as the gamma voltages VGREF. In an example embodiment, the gamma voltage generation circuit 150 may be included in the data driver circuit 130. As described below, the gamma voltage generation circuit 150 may generate gamma voltages VGREF corresponding to respective colors.

The display panel 110 has a zigzag connection structure according to some example embodiments. Further, the timing controller 120, the data driver circuit 130, the gate driver circuit 140 and the gamma voltage generation circuit 150 may have configuration for driving the display panel of the zigzag connection structure as will be described below.

FIG. 4 is a diagram illustrating a zigzag connection structure of a display panel according to an example embodiment. FIG. 4 illustrates sub pixels of first through fourth rows RW1~RW4 and first through fourth columns CM1~CM4 for convenience of illustration and the numbers of the pixel rows and the pixel columns may vary depending on the resolution of the display panel.

For example, the zigzag connection structure ZZSTa of a display panel refers to a connection structure in which (1) a plurality of RG sub pixel pairs and a plurality of BG sub pixel pairs are alternately arranged both in a row direction and in a column direction, and (2) the RG sub pixels included in a first row and the RG sub pixel pairs included in a second row immediately adjacent to the first row are connected to a first common gate line, and the BG sub pixel pairs included in a second row and the BG sub pixel pairs included in a third row immediately adjacent to the second row are connected to a second common gate line. Referring to FIG. 4, a zigzag connection structure ZZSTa of a display panel according to an example embodiment may include RG sub pixel pairs RGP1~RGP4 and BG sub pixel pairs BGP1~BGP4.

Each of the RG sub pixel pairs RGP1~RGP4 includes one R sub pixel and one G sub pixel adjacent in the row direction DR1. For example, the first RG sub pixel pair RGP1 includes the R sub pixel R11 and the G sub pixel G12 in the first row RW1, the second RG sub pixel pair RGP2 includes the R sub pixel R23 and the G sub pixel G24 in the second row RW2, the third RG sub pixel pair RGP3 includes the R sub pixel R31 and the G sub pixel G32 in the third row RW3, and the fourth RG sub pixel pair RGP4 includes the R sub pixel R43 and the G sub pixel G44 in the fourth row RW4.

Each of the BG sub pixel pairs BGP1~BGP4 includes one B sub pixel and one G sub pixel adjacent in the row direction DR1. For example, the first BG sub pixel pair BGP1 includes the B sub pixel B13 and the G sub pixel G14 in the first row RW1, the second BG sub pixel pair RGP2 includes the B sub pixel R21 and the G sub pixel G22 in the second row RW2, the third BG sub pixel pair BGP3 includes the B sub pixel B33 and the G sub pixel G34 in the third row RW3, and the fourth BG sub pixel pair BGP4 includes the B sub pixel B41 and the G sub pixel G42 in the fourth row RW4.

The RG sub pixel pairs RGP1~RGP4 and the BG sub pixel pairs BGP1~BGP4 are alternately arranged in the row direction DR1 and the column direction DR2.

As a result, in the zigzag connection structure ZZSTa, the RG sub pixel pairs included in an odd-numbered row of two adjacent rows and the RG sub pixel pairs included in an even-numbered row of the two adjacent rows are alternately connected to a common gate line, and BG sub pixel pairs included in an odd-numbered row of two adjacent rows and BG sub pixel pairs included in an even-numbered row of the two adjacent rows are alternately connected to a common gate line.

For example, as illustrated in FIG. 4, the RG sub pixel pairs RGP1 and RGP2 in the adjacent first and second rows RW1 and RW2 are connected commonly to the second gate line GL2, the BG sub pixel pairs BGP2 and RGP3 in the adjacent second and third rows RW2 and RW3 are connected commonly to the third gate line GL3, and the RG sub pixel pairs RGP3 and RGP4 in the adjacent third and fourth rows RW3 and RW4 are connected commonly to the fourth gate line GL4. According to this example embodiment, the BG sub pixel pair BGP1 in the first row RW1 may be connected to the first gate line GL1 corresponding to an upper end, and the BG sub pixel pair BGP4 in the fourth row RW4 may be connected to the fifth gate line GL5 corresponding to a lower end.

As described below, through such zigzag connection structure ZZSTa, line flickering in the row direction DR1 and image degradation by interlace scanning may be reduced. Also an interlace operation may be performed more efficiently and dynamic power consumption may be reduced through the zigzag connection structure ZZST. Further occupation area of a gamma voltage generation circuit may be reduced and static power consumption may be reduced through the zigzag connection structure ZZST.

Figure 5:
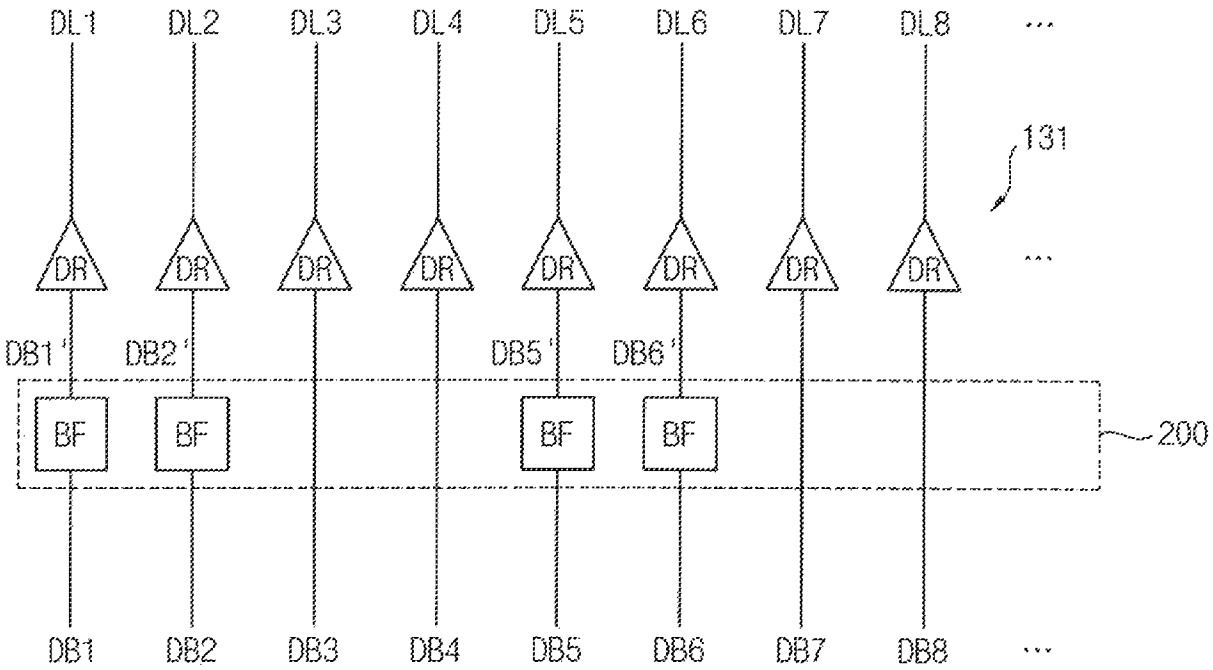
FIG. 5 is a diagram illustrating an example embodiment of a data driver included in the display device of FIG. 2.

FIG. 5 is a diagram illustrating an example embodiment of a data driver included in the display device of FIG. 2.

Referring to FIG. 5, a data driver circuit 131 may include a plurality of data drivers DR and a half line buffer circuit 200.

Each of the data drivers DR is connected to each of the data lines DL1~DL8. The half line buffer circuit may include a plurality of unit buffers BF. The unit buffers BF may delay and output data corresponding to a half of the plurality of data lines DL1~DL8 by one horizontal period. Accordingly the number of the unit buffers is K when the number of the data lines 2K.

In case of the zigzag connection structure ZZSTa of FIG. 4, the first BG sub pixel pair BGP1 is driven when the first gate line GL1 is enabled, the first RG sub pixel pair RGP1 and the second RG sub pixel pair RGP2 are driven when the second gate line GL2 is enabled, the second BG sub pixel pair BGP and the third BG sub pixel pair BGP3 are driven when the third gate line GL3 is enabled, the third RG sub pixel pair RGP3 and the fourth RG sub pixel pair RGP4 are driven when the fourth gate line GL4 is enabled, and the fourth BG sub pixel pair BGP4 is driven when the fifth gate line GL5 is enabled.

When the gate lines GL1~GL5 are enabled sequentially from the first gate line GL1 to the fifth gate line GL5 by the interval of the horizontal period, the sub pixel pairs RGP1, RGP2, RGP3 and BGP4 connected to the first and second data lines DL1 and DL2 are driven to be delayed by the horizontal period with respect to the sub pixel pairs BGP1, RGP2, BGP3 and RGP4 connected to the third and fourth data lines DL3 and DL4 Thus, the sub pixel pairs connected to the (4K−3)-th data line (K is a positive integer) and (4K−2)-th data line are driven to be delayed by the horizontal period with respect to the sub pixel pairs connected to the (4K−1)-th data line and the 4K-th data line.

The data driver 131 receives data bits DB1~DB8 corresponding to the same row in synchronization with the same horizontal period, and the half line buffer circuit 200 delay the corresponding data bits DB1, DB2 DB5 and DB6 by one horizontal period to output the delayed data bits DB1', DB2', DB5' and DB6'. As a result, the data driver circuit 131 including the half line buffer circuit 200 of FIG. 5 may be adapted to the zigzag connection structure ZZSTa of FIG. 4 to drive the data lines DL1~DL8 during the (M+1)-th horizontal period based on the data bits DB3, DB4, DB7 and DB8 corresponding to the (M+1)-th horizontal period and the data bits DB1', DB2', DB5' and DB6' corresponding to the M-th horizontal period.

Figure 6:
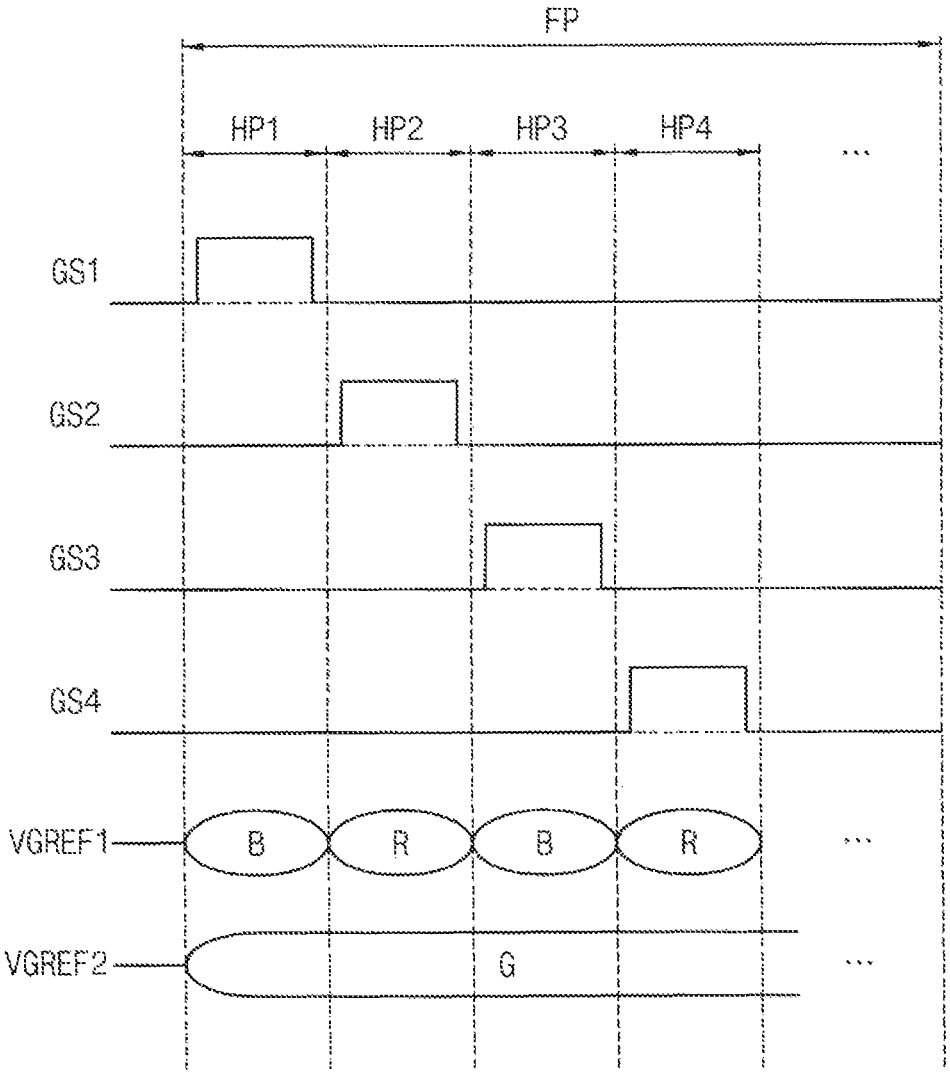
FIG. 6 is a diagram illustrating an operation of a display device in a normal operation mode according to example embodiments.

FIG. 6 is a diagram illustrating an operation of a display device in a normal operation mode according to an example embodiment. The normal operation of FIG. 6 corresponds to the zigzag connection structure ZZSTa of FIG. 4 and the data driving circuit 131 of FIG. 5.

Referring to FIGS. 4, 5, and 6, in the normal operation mode, both of the RG sub pixel pairs and the BG sub pixel pairs may be driven during each frame period FR. "Driving a sub pixel pair" represents that voltage signals or current signals corresponding to the new data are applied to the sub pixel pair. Thus, undriven sub pixel pair(s) may maintain the states corresponding to the previously applied voltage or current signals.

The data driver circuit 131 receives first gamma voltages VGREF1 and second gamma voltages VGREF2 from the gamma voltage generation circuit 150 in FIG. 2. The first gamma voltages VGREF1 may include gamma voltages corresponding to the B sub pixels and gamma voltage corresponding to R sub pixels in an alternate manner per horizontal period. The second gamma voltages VGREF2 may include gamma voltages corresponding to the G sub pixels steadily regardless of the horizontal periods.

For example, in case of FIGS. 4, 5, and 6, the first gamma voltages VGREF1 may be used to drive the odd-numbered data lines DL1, DL3, DL5, and DL7, and the second gamma voltages VGREF2 may be used to drive the even-numbered data lines DL2, DL4, DL6, and DL8.

During the first horizontal period HP1, the first gate driving signal GS1 on the first gate line GL1 is activated to drive the sub pixels B13 and G14 or the sub pixel pair BGP1 that are connected to the enabled first gate line GL1. The B sub pixels and the G sub pixels are driven during the first horizontal period HP1, and thus the first gamma voltages VGREF1 correspond to the B sub pixels and the second gamma voltages VGREF2 correspond to the G sub pixels.

During the second horizontal period HP2, the second gate driving signal GS2 on the second gate line GL2 is activated to drive the sub pixels R11, G12, R23 and G24 or the sub pixel pairs RGP1 and RGP2 that are connected to the enabled second gate line GL2. The R sub pixels and the G sub pixels are driven during the second horizontal period HP2, and thus the first gamma voltages VGREF1 correspond to the R sub pixels and the second gamma voltages VGREF2 correspond to the G sub pixels.

During the third horizontal period HP3, the third gate driving signal GS3 on the third gate line GL3 is activated to drive the sub pixels B21, G22, B33, and G34 or the sub pixel pair BGP2 and BGP3 that are connected to the enabled third gate line GL3. The B sub pixels and the G sub pixels are driven during the third horizontal period HP3, and thus the first gamma voltages VGREF1 correspond to the B sub pixels and the second gamma voltages VGREF2 correspond to the G sub pixels.

During the fourth horizontal period HP4, the fourth gate driving signal GS4 on the fourth gate line GL4 is activated to drive the sub pixels R31, G32, R43, and G44 or the sub pixel pairs RGP3 and RGP4 that are connected to the enabled fourth gate line GL4. The R sub pixels and the G sub pixels are driven during the fourth horizontal period HP4, and thus the first gamma voltages VGREF1 correspond to the R sub pixels and the second gamma voltages VGREF2 correspond to the G sub pixels.

As such, all of the gate lines are driven sequentially during each frame period FP in the normal operation mode, and thus the BG sub pixel pairs and the RG sub pixel pairs may be alternately driven per horizontal period.

Line flickering along the row direction DR1 may be reduced because the sub pixel pairs forming the zigzag pattern in the two adjacent rows are driven during each horizontal period. Further, as will be described with reference to FIGS. 16 through 18D, the gamma voltages corresponding to the B sub pixels and the gamma voltages corresponding to the R sub pixels may be alternately generated per horizontal period using one gamma voltage generator, when the normal operation is performed by assigning each data driver to each data line for the zigzag connection structure ZZSTa as described with reference to FIGS. 4 and 5. Accordingly the occupation area of the gamma voltage generation circuit may be reduced and the static power consumption may be reduced.

FIGS. 7A, 7B, 7C, and 8 are diagrams for describing sequence of display data applied to a display panel in the normal operation mode of FIG. 6. The sub pixels Cij (C=R, G, B, i=1~6, j=1~8) arranged in a matrix form of six rows and eight columns are described in FIGS. 7A through 8 for convenience of illustration, and the numbers of the pixel rows and the pixel columns may vary depending on the resolution of the display panel.

FIG. 7A shows the hatched sub pixels that are driven during the first horizontal period HP1, FIG. 7B shows the hatched sub pixels that are driven during the second horizontal period HP2, FIG. 7C shows the hatched sub pixels that are driven during the third horizontal period HP3, and FIG. 8 shows the hatched sub pixels that are driven during each frame period FP including all of the horizontal periods.

As illustrated in FIGS. 7A, 7B, and 7C, the BG sub pixel pairs may be driven during the odd-numbered horizontal periods and the RG sub pixel pairs may be driven during the even-numbered horizontal periods. As a result, all of the sub pixel pairs may be driven during each frame period FP as illustrated in FIG. 8.

As such, only the RG sub pixel pairs or only the BG sub pixel pairs may be driven during each horizontal period in the normal operation mode through the zigzag connection structure ZZSTa according to some example embodiments. Thus, the line flickering in the row direction may be reduced, the occupation area of the gamma voltage generation circuit may be reduced and the static power consumption may be reduced.

Figure 9:
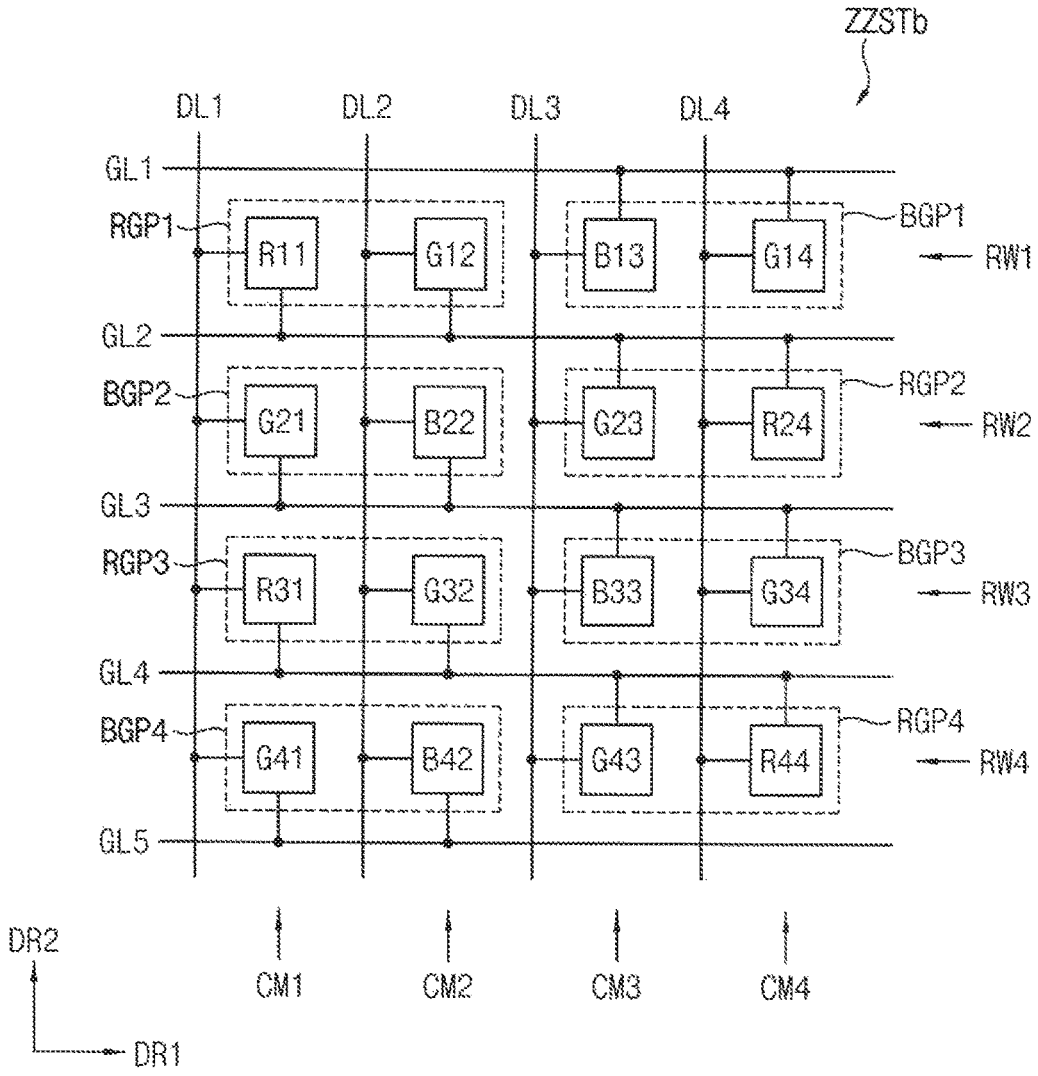
FIG. 9 is a diagram illustrating a zigzag connection structure of a display panel according to an example embodiment.

FIG. 9 is a diagram illustrating a zigzag connection structure of a display panel according to an example embodiment. FIG. 9 illustrates sub pixels of first through fourth rows RW1~RW4 and first through fourth columns CM1~CM4 for convenience of illustration and the numbers of the pixel rows and the pixel columns may vary depending on the resolution of the display panel.

Referring to FIG. 9, a zigzag connection structure ZZSTb of a display panel may include RG sub pixel pairs RGP1~RGP4 and BG sub pixel pairs BGP1~BGP4.

Each of the RG sub pixel pairs RGP1~RGP4 includes one R sub pixel and one G sub pixel adjacent in the row direction DR1. For example, the first RG sub pixel pair RGP1 includes the R sub pixel R11 and the G sub pixel G12 in the first row RW1, the second RG sub pixel pair RGP2 includes the G sub pixel G23 and the R sub pixel R24 in the second row RW2, the third RG sub pixel pair RGP3 includes the R sub pixel R31 and the G sub pixel G32 in the third row RW3, and the fourth RG sub pixel pair RGP4 includes the G sub pixel G43 and the R sub pixel R44 in the fourth row RW4. The positions of the R sub pixel and the G sub pixel of the second RG sub pixel pair RGP2 and the fourth RG sub pixel pair RGP4 in the zigzag connection structure ZZSTb of FIG. 9 are exchanged in comparison with the zigzag connection structure ZZSTa of FIG. 4.

Each of the BG sub pixel pairs BGP1~BGP4 includes one B sub pixel and one G sub pixel adjacent in the row direction DR1. For example, the first BG sub pixel pair BGP1 includes the B sub pixel B13 and the G sub pixel G14 in the first row RW1, the second BG sub pixel pair BGP2 includes the G sub pixel G21 and the B sub pixel B22 in the second row RW2, the third BG sub pixel pair BGP3 includes the B sub pixel B33 and the G sub pixel G34 in the third row RW3, and the fourth BG sub pixel pair BGP4 includes the G sub pixel G41 and the B sub pixel B42 in the fourth row RW4. The positions of the B sub pixel and the G sub pixel of the second BG sub pixel pair BGP2 and the fourth BG sub pixel pair BGP4 in the zigzag connection structure ZZSTb of FIG. 9 are exchanged in comparison with the zigzag connection structure ZZSTa of FIG. 4.

The RG sub pixel pairs RGP1~RGP4 and the BG sub pixel pairs BGP1~BGP4 are alternately arranged in the row direction DR1 and the column direction DR2.

As a result, in the zigzag connection structure ZZSTb, the RG sub pixel pairs included in an odd-numbered row of two adjacent rows and the RG sub pixel pairs included in an even-numbered row of the two adjacent rows are alternately connected to a common gate line, and BG sub pixel pairs included in an odd-numbered row of two adjacent rows and BG sub pixel pairs included in an even-numbered row of the two adjacent rows are alternately connected to a common gate line.

For example, as illustrated in FIG. 9, the RG sub pixel pairs RGP1 and RGP2 in the adjacent first and second rows RW1 and RW2 are connected commonly to the second gate line GL2, the BG sub pixel pairs RGP2 and RGP3 in the adjacent second and third rows RW2 and RW3 are connected commonly to the third gate line GL3, and the RG sub pixel pairs RGP3 and RGP4 in the adjacent third and fourth rows RW3 and RW4 are connected commonly to the fourth gate line GL4. According to this example embodiment, the BG sub pixel pair BGP1 in the first row RW1 may be connected to the first gate line GUI corresponding to an upper end, and the BG sub pixel pair BGP4 in the fourth row RW4 may be connected to the fifth gate line GL5 corresponding to a lower end.

Through such zigzag connection structure ZZSTb, line flickering in the row direction DR1 and image degradation by interlace scanning may be reduced. Also an interlace operation may be performed more efficiently and dynamic power consumption may be reduced through the zigzag connection structure ZZST. Further occupation area of a gamma voltage generation circuit may be reduced and static power consumption may be reduced through the zigzag connection structure ZZST.

Figure 10:
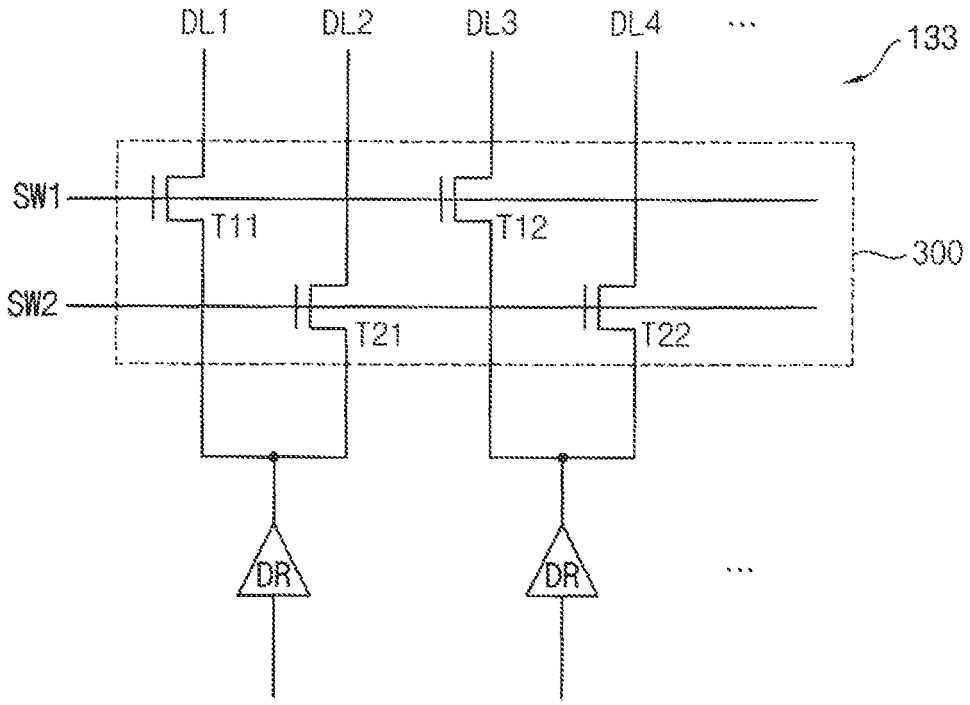
FIG. 10 is a diagram illustrating an example embodiment of a data driver included in the display device of FIG. 2.

FIG. 10 is a diagram illustrating an example embodiment of a data driver included in the display device of FIG. 2.

Referring to FIG. 10, a data driver circuit 133 may include a plurality of data drivers DR and a switch circuit 300. Although omitted in FIG. 10, the data driver circuit 133 may further include a half line buffer circuit 200 as described with reference to FIG. 5.

Each of the data drivers DR is assigned to two adjacent data lines. For example, one data driver DR is assigned to the first and second data lines DL1 and DL2, and another data driver DR is assigned to the third and fourth data lines DL3 and DL4.

The switch circuit 300 may selectively connect each of the data drivers DR to one of the two adjacent data lines. For example, the switch circuit 300 may include first switching elements T11 and T12 that are turned on in response to a first switch signal SW1 and second switching elements T21 and T22 that are turned on in response to a second switch signal SW2. The first switch signal SW1 and the second switch signal SW2 may be included in the timing control signal CONT2 provided from the timing controller 120 in FIG. 2. The first switch signal SW1 and the second switch signal SW2 may be activated selectively. When the first switch signal SW1 is activated, the first switching elements T11 and T12 are turned on to connect the data drivers DR to the odd-numbered data lines DL1 and DL3. When the second switch signal SW2 is activated, the second switching elements T21 and T22 are turned on to connect the data drivers DR to the even-numbered data lines DL2 and DL4.

In case of the zigzag connection structure ZZSTa of FIG. 4 or the zigzag connection structure ZZSTb of FIG. 9, the first BG sub pixel pair BGP1 is driven when the first gate line GL1 is enabled, the first RG sub pixel pair RGP1 and the second RG sub pixel pair RGP2 are driven when the second gate line GL2 is enabled, the second BG sub pixel pair BGP2 and the third BG sub pixel pair BGP3 are driven when the third gate line GL3 is enabled, the third RG sub pixel pair RGP3 and the fourth RG sub pixel pair RGP4 are driven when the fourth gate line GL4 is enabled, and the fourth BG sub pixel pair BGP4 is driven when the fifth gate line GL5 is enabled.

When the gate lines GL1~GL5 are enabled sequentially from the first gate line GL1 to the fifth gate line GL5 by the interval of the horizontal period, the first switch signal SW1 and the second switch signal SW2 may be activated sequentially during the each horizontal period. As a result, all of the 2K data lines (K is a positive integer) may be driven during each horizontal period using K data drivers.

Figure 11:
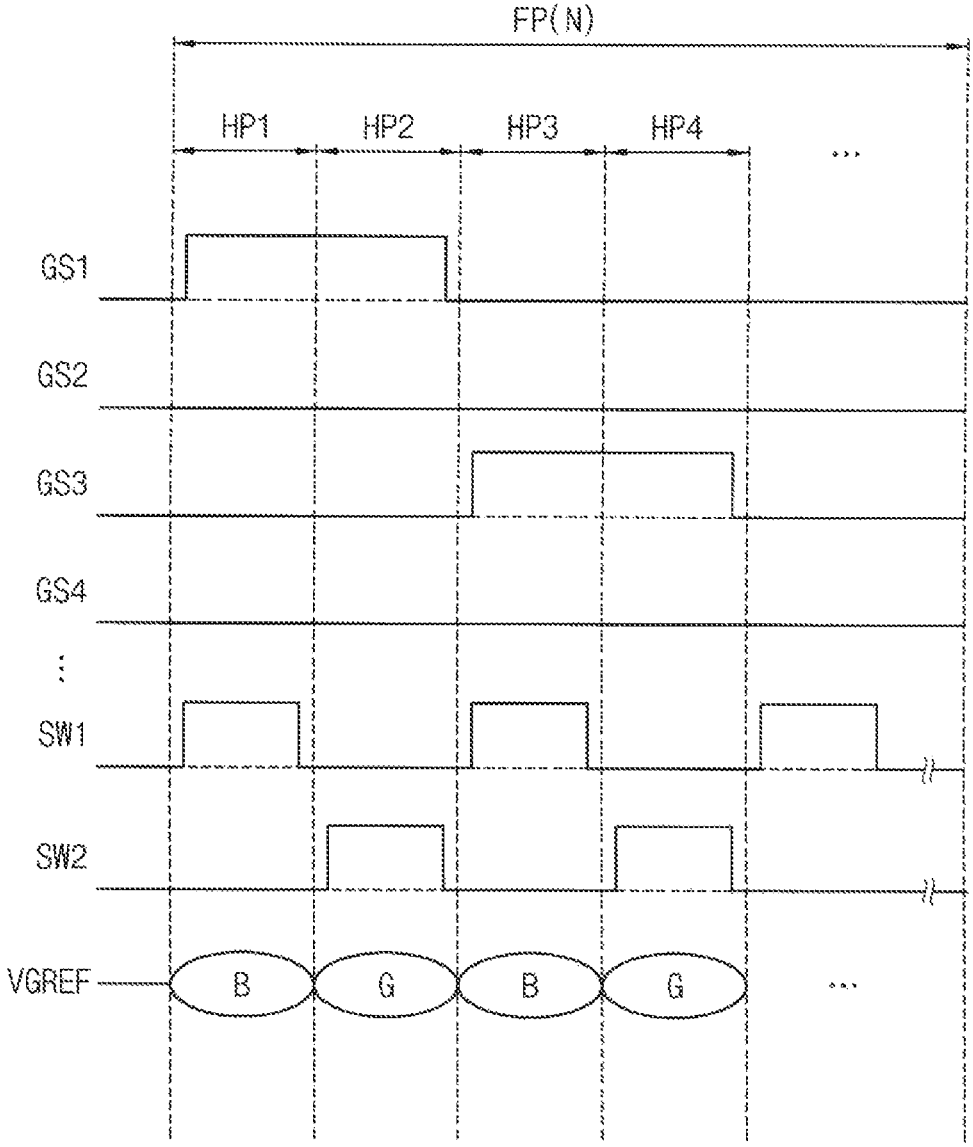
FIG. 11 is a diagram illustrating an operation of a display device during an N-th frame period in an interlace operation mode according to an example embodiment.

FIG. 11 is a diagram illustrating an operation of a display device during an N-th frame period in an interlace operation mode according to an example embodiment. The interlace operation during the N-th frame period of FIG. 11 corresponds to the zigzag connection structure ZZSTa of FIG. 4 and the data driving circuit 133 of FIG. 10.

Referring to FIGS. 4, 10 and 11, in the interlace operation mode, only the BG sub pixel pairs may be driven during the N-th frame period FP(N). Accordingly, undriven RG sub pixel pairs may maintain the states corresponding to the previously applied voltage or current signals.

The data driver circuit 133 receives gamma voltages VGREF from the gamma voltage generation circuit 150 in FIG. 2. During the N-th frame period FP(N), the gamma voltages VGREF1 may include gamma voltages corresponding to the B sub pixels and gamma voltage corresponding to G sub pixels in an alternate manner during each horizontal period.

For example, in configuration of FIGS. 4 and 10, the gamma voltages corresponding to the B sub pixels may be used to drive the odd-numbered data lines DL1 and DL3, and the gamma voltages corresponding to the G sub pixels may be used to drive the even-numbered data lines DL2 and DL4.

Comparing FIGS. 6 and 11, each of the odd-numbered gate driving signals GS1 and GS3 is activated during the two consecutive horizontal periods in FIG. 11, and thus the operation speed of FIG. 11 is half the operation speed of FIG. 6.

During the first and second horizontal periods HP1 and HP2, the first gate driving signal GS1 on the first gate line GL1 is activated, and the first and second signals SW1 and SW2 are sequentially activated to drive the sub pixels B13 and G14 or the sub pixel pair BGP1 that are connected to the enabled first gate line GL1. The B sub pixels and the G sub pixels are sequentially driven during the first and second horizontal periods HP1 and HP2, and thus the gamma voltages VGREF are switched between the gamma voltages corresponding to the B sub pixels and the gamma voltages corresponding to the G sub pixels.

During the third and fourth horizontal period HP3 and HP4, the third gate driving signal GS3 on the third gate line GL3 is activated and the first and second signals SW1 and SW2 are sequentially activated to drive the sub pixels B21, G22, B33 and G34 or the sub pixel pair BGP2 and BGP3 that are connected to the enabled third gate line GL3. In the same way as the first and second horizontal periods HP1 and HP2, the B sub pixels and the G sub pixels are sequentially driven during the third and fourth horizontal periods HP3 and HP4, and thus the gamma voltages VGREF are switched between the gamma voltages corresponding to the B sub pixels and the gamma voltages corresponding to the G sub pixels. Although not illustrated in FIG. 11, the BG sub pixel pairs connected to the fifth gate line may be driven during the fifth and sixth horizontal periods, the BG sub pixel pairs connected to the seventh gate line may be driven during the seventh and eighth horizontal periods, and so on.

As such, only the odd-numbered gate lines are driven sequentially and the even-numbered gate lines are disabled during the N-th frame period FP(N) in the interlace operation mode, and thus only the BG sub pixel pairs are driven with new data bits and the RG sub pixel pairs maintains the previous states during the N-th frame period FP(N).

FIGS. 12A, 12B and 12C are diagrams for describing sequence of display data applied to a display panel during the N-th frame period in the interlace operation mode of FIG. 11. The sub pixels Cij=(C=R, G, B, i=1~6, j=1~8) arranged in a matrix form of six rows and eight columns are described in FIGS. 12A through 12C for convenience of illustration, and the numbers of the pixel rows and the pixel columns may vary depending on the resolution of the display panel.

FIG. 12A shows the hatched sub pixels that are driven during the first and second horizontal periods HP1 and HP2 of the N-th frame period FP(N), FIG. 12B shows the hatched sub pixels that are driven during the third and fourth horizontal periods HP3 and HP4 of the N-th frame period FP(N), and FIG. 12C shows the hatched sub pixels that are driven during the N-th frame period FP(N) including all of the horizontal periods.

As illustrated in FIGS. 12A, 12B and 12C, only the BG sub pixel pairs may be driven by enabling the odd-numbered gate lines sequentially and the RG sub pixel pairs may not be driven during the N-th frame period FP(N).

Figure 13:
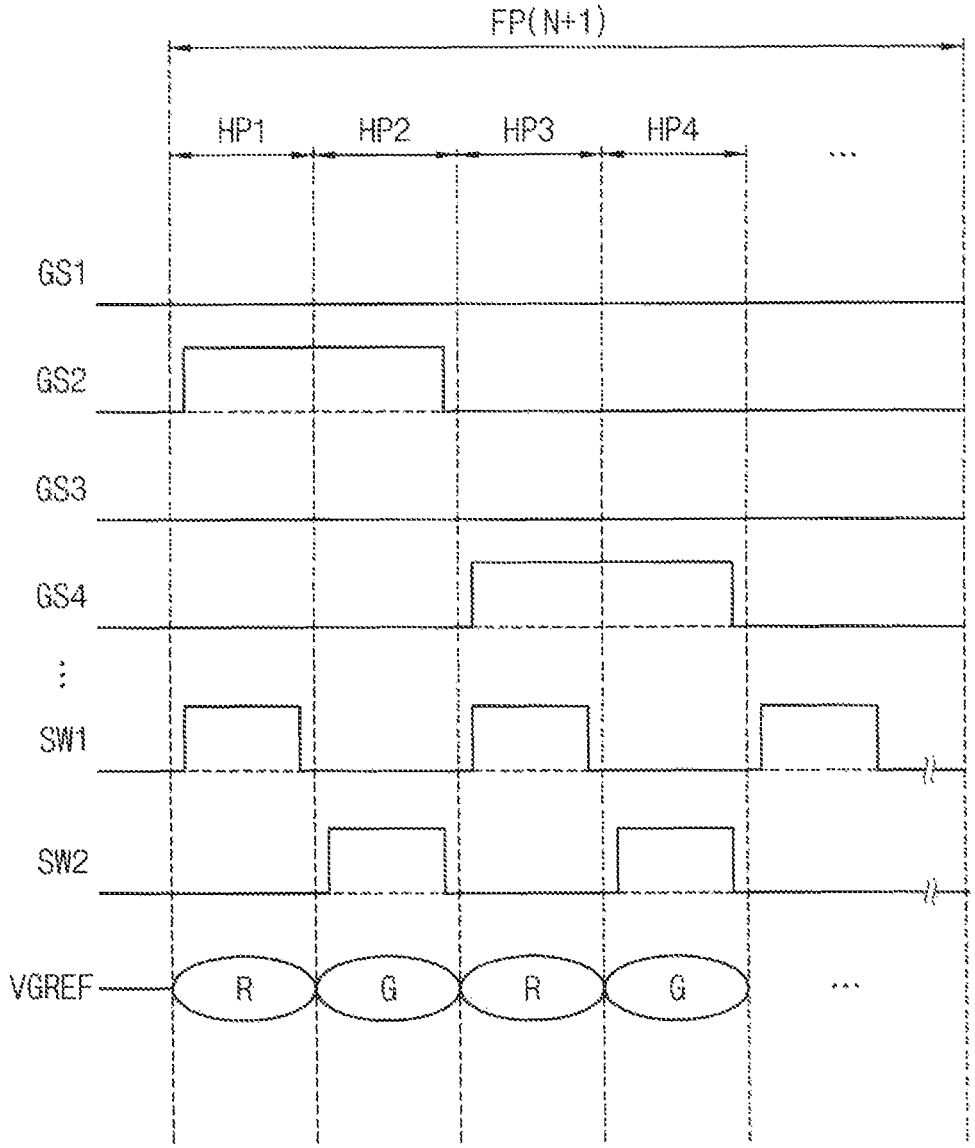
FIG. 13 is a diagram illustrating an operation of a display device during an (N+1)-th frame period in an interlace operation mode according to an example embodiment.

FIG. 13 is a diagram illustrating an operation of a display device during an (N+1)-th frame period in an interlace operation mode according to an example embodiment. The interlace operation during the (N+1)-th frame period of FIG. 13 corresponds to the zigzag connection structure ZZSTa of FIG. 4 and the data driving circuit 133 of FIG. 10. The (N+1)-th frame period of FIG. 13 corresponds to a frame period next to the N-th frame period of FIG. 11.

Referring to FIGS. 4, 10 and 13, in the interlace operation mode, only the RG sub pixel pairs may be driven during the (N+1)-th frame period FP(N+1). Accordingly, undriven BG sub pixel pairs may maintain the states corresponding to the previously applied voltage or current signals.

The data driver circuit 133 receives gamma voltages VGREF from the gamma voltage generation circuit 150 in FIG. 2. During the (N+1)-th frame period FP(N+1), the gamma voltages VGREF1 may include gamma voltages corresponding to the R sub pixels and gamma voltage corresponding to G sub pixels in an alternate manner during each horizontal period.

For example, in configuration of FIGS. 4 and 10, the gamma voltages corresponding to the G sub pixels may be used to drive the odd-numbered data lines DL1 and DL3, and the gamma voltages corresponding to the G sub pixels may be used to drive the even-numbered data lines DL2 and DL4.

Comparing FIGS. 6 and 13, each of the even-numbered gate driving signals GS2 and GS3 is activated during the two consecutive horizontal periods in FIG. 13, and thus the operation speed of FIG. 13 is half the operation speed of FIG. 6.

During the first and second horizontal periods HP1 and HP2, the second gate driving signal GS2 on the second gate line GL2 is activated and the first and second signals SW1 and SW2 are sequentially activated to drive the sub pixels R11, G12, R23 and G24 or the sub pixel pairs RGP1 and RGP2 that are connected to the enabled second gate line GL2. The R sub pixels and the G sub pixels are sequentially driven during the first and second horizontal periods HP1 and HP2, and thus the gamma voltages VGREF are switched between the gamma voltages corresponding to the R sub pixels and the gamma voltages corresponding to the G sub pixels.

During the third and fourth horizontal period HP3 and HP4, the fourth gate driving signal GS4 on the fourth gate line GL4 is activated and the first and second signals SW1 and SW2 are sequentially activated to drive the sub pixels R31, G32, R43 and G44 or the sub pixel pair RGP3 and RGP4 that are connected to the enabled fourth gate line GL4. In the same way as the first and second horizontal periods HP1 and HP2, the R sub pixels and the G sub pixels are sequentially driven during the third and fourth horizontal periods HP3 and HP4, and thus the gamma voltages VGREF are switched between the gamma voltages corresponding to the R sub pixels and the ma voltages corresponding to the G sub pixels. Although not illustrated in FIG. 13, the RG sub pixel pairs connected to the sixth gate line may be driven during the fifth and sixth horizontal periods, the RG sub pixel pairs connected to the eighth gate line may be driven during the seventh and eighth horizontal periods, and so on.

As such, only the even-numbered gate lines are driven sequentially and the odd-numbered gate lines are disabled during the (N+1)-th frame period FP(N+1) in the interlace operation mode, and thus only the RG sub pixel pairs are driven with new data bits and the BG sub pixel pairs maintains the previous states during the (N+1)-th frame period FP(N+1).

FIGS. 14A, 14B, and 14C are diagrams for describing sequence of display data applied to a display panel during the (N+1)-th frame period in the interlace operation mode of FIG. 13. The sub pixels Cij (C=R, G, B, i=1~6, j=1~8) arranged in a matrix form of six rows and eight columns are described in FIGS. 14A through 14C for convenience of illustration, and the numbers of the pixel rows and the pixel columns may vary depending on the resolution of the display panel.

FIG. 14A shows the hatched sub pixels that are driven during the first and second horizontal periods HP1 and HP2 of the (N+1)-th frame period FP(N+1), FIG. 14B shows the hatched sub pixels that are driven during the third and fourth horizontal periods HP3 and HP4 of the (N+1)-th frame period FP(N+1), and FIG. 14C shows the hatched sub pixels that are driven during the (N+1)-th frame period FP(N+1) including all of the horizontal periods.

As illustrated in FIGS. 14A, 14B, and 14C, only the RG sub pixel pairs may be driven by enabling the even-numbered gate lines sequentially and the BG sub pixel pairs may not be driven during the (N+1)-th frame period FP(N+1).

As such, in the interlace operation mode of the zigzag connection structure ZZSTa according to some example embodiments, line flickering along the row direction DR1 may be reduced because the sub pixel pairs forming the zigzag pattern in the two adjacent rows are driven during each horizontal period. Further, as will be described with reference to FIGS. 16 through 18D, the gamma voltages corresponding to the B sub pixels, the gamma voltages corresponding to the R sub pixels and the gamma voltage corresponding to the G sub pixels may be alternately generated using one gamma voltage generator, when the interlace operation is performed by assigning each data driver to two adjacent data lines for the zigzag connection structure ZZSTa as described with reference to FIGS. 4 and 10. Thus, using only one gamma voltage generator, the gamma voltages corresponding to the B sub pixels and the gamma voltage corresponding to the G sub pixels may be alternately generated during the N-th frame period FP(N) and the gamma voltages corresponding to the R sub pixels and the gamma voltage corresponding to the G sub pixels may be alternately generated during the (N+1)-th frame period FP(N) next to the N-th frame period FP(N). Accordingly the occupation area of the gamma voltage generation circuit may be reduced and the static power consumption may be reduced.

As such, in the interlace operation mode as described with reference to FIGS. 11 and 13, only the odd-numbered gate lines are driven during one frame period of two adjacent frame periods and only the even-numbered gate lines are driven during the other frame period of the two adjacent frame periods. In comparison with the normal operation mode as described with reference to FIG. 6, each gate driving signal may be activated in the interlace operation mode two times longer than the normal operation mode. As a result, the operational frequency may be reduced in the interlace operation mode to reduce the power consumption.

Figure 15:
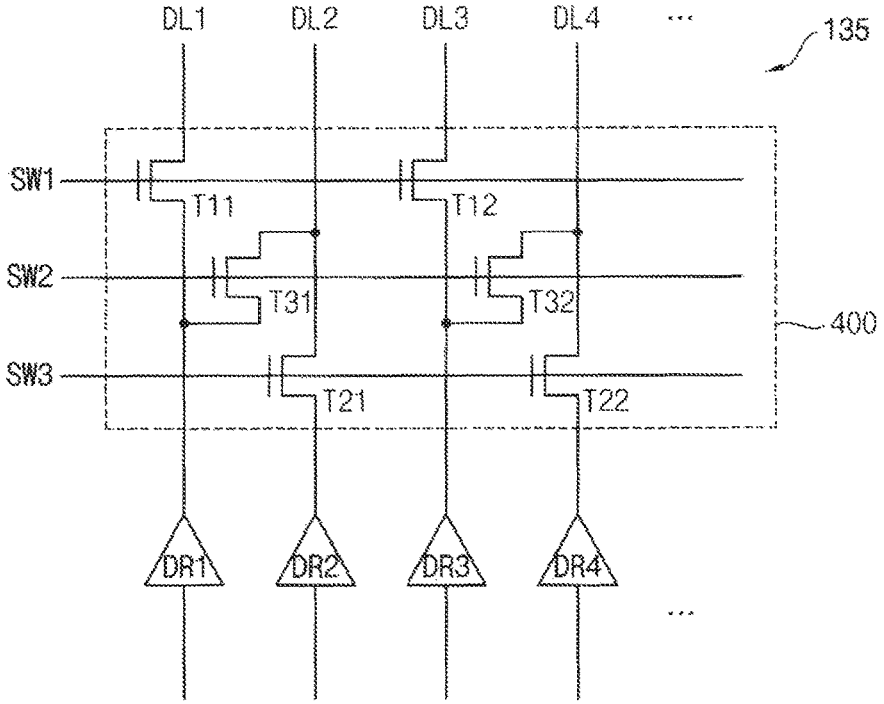
FIG. 15 is a diagram illustrating an example embodiment of a data driver included in the display device of FIG. 2.

FIG. 15 is a diagram illustrating an example embodiment of a data driver included in the display device of FIG. 2.

Referring to FIG. 15, a data driving circuit 135 may include a plurality of data drivers DR and a switch circuit 400. Although omitted in FIG. 15, the data driver circuit 135 may further include a half line buffer circuit 200 as described with reference to FIG. 5.

Each of the data drivers DR1~DR4 is assigned to each of the data lines DL1~DL4. The switch circuit 400 controls connections between each data driver and each data line and connections between two adjacent odd-numbered and even-numbered data lines.

For example, the switch circuit 400 may include first switching elements T11 and T12 that are turned on in response to a first switch signal SW1, second switching elements T21 and T22 that are turned on in response to a second switch signal SW2, and third switching elements T31 and T32 that are turned on in response to a third switch signal SW3. The first switch signal SW1, the second switch signal SW2 and the third switch signal SW3 may be included in the timing control signal CONT2 provided from the timing controller 120 in FIG. 2. The first switching elements T11 and T12 and the second switching elements T21 and T22 may control connections between the data drivers DR1~DR4 and the data lines DL1~DL4, respectively, in response to the first switch signal SW1 and the second switch signal SW2. The third switching elements T31 and T32 may control connection between the adjacent odd-numbered and even-numbered data lines in response to the third switch signal SW3.

Using the switch circuit 400 of FIG. 15, the data driving circuit of FIGS. 5 and 10 may be implemented selectively. In some example embodiments, the first and second switch signals SW1 and SW2 may be activated and the third switch signal SW3 may be deactivated to implement the configuration as illustrated in FIG. 5. In other example embodiments, the third switch signal SW3 may be activated and the first and second switch signals SW1 and SW2 may be alternately activated per horizontal period to implement the configuration as illustrated in FIG. 10. In this case, the odd-numbered data drivers DR1 and DR3 or the even-numbered data drivers DR2 and DR4 may be disabled.

Figure 16:
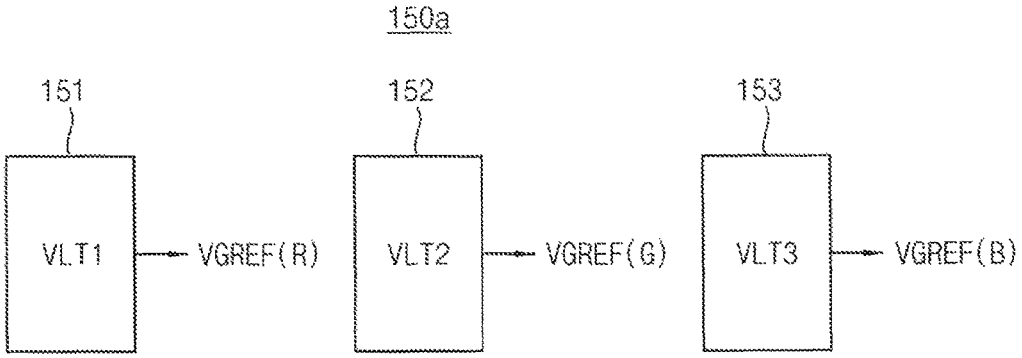
FIG. 16 is a diagram illustrating a gamma voltage generator.

FIG. 16 is a diagram illustrating a gamma voltage generator.

Referring to FIG. 16, a gamma voltage generation circuit 150*a* includes a first gamma voltage generator (VLT1) 151, a second gamma voltage generator (VLT2) 152 and a third gamma voltage generator (VLT3) 153. The first gamma voltage generator 151 generates gamma voltages VGREF (R) corresponding to the R sub pixels, the second gamma voltage generator 152 generates gamma voltages VGREF (G) corresponding to the G sub pixels and the third gamma voltage generator 153 generates gamma voltages VGREF (B) corresponding to the B sub pixels.

If the R, G and B sub pixels are connected to the same gate line and each data driver is connected to each data line as illustrated in FIG. 5, the three gamma voltage generators 151, 152 and 153, which operate independently, as illustrated in FIG. 16 may be desired. As such, the gamma voltage generators may occupy relatively large area and increase the static power consumption.

Figure 17A:
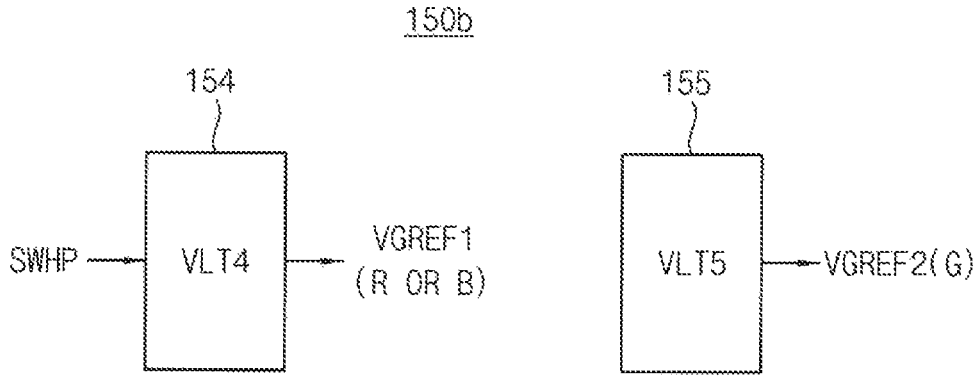
FIG. 17A is a diagram illustrating a gamma voltage generation circuit according to an example embodiment.
Figure 17B:
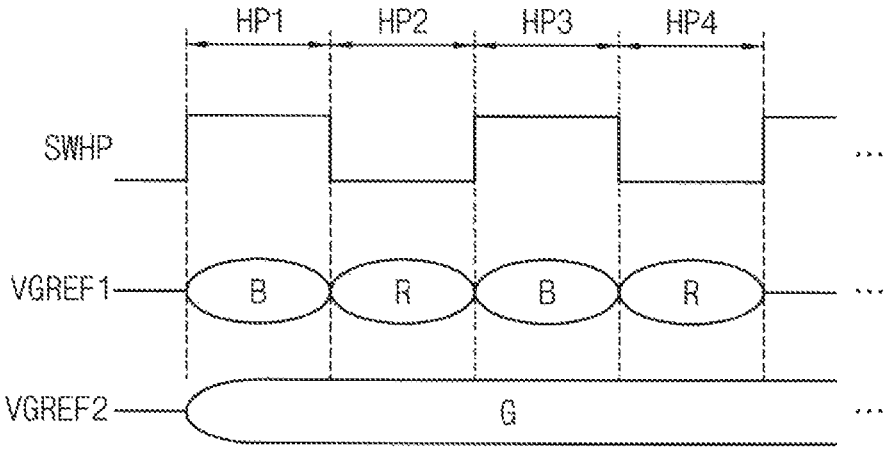
FIG. 17B is a timing diagram illustrating an operation of the gamma voltage generation circuit of FIG. 17A.

FIG. 17A is a diagram illustrating a gamma voltage generation circuit according to an example embodiment, and FIG. 17B is a timing diagram illustrating an operation of the gamma voltage generation circuit of FIG. 17A.

A gamma voltage generation circuit 150*b* of FIG. 17A includes a first gamma voltage generator (VLT4) 154 and a second gamma voltage generator (VLT5) 155.

Referring to FIGS. 17A and 17B, the first gamma voltage generator 154 may selectively generate R gamma voltages corresponding to the R sub pixels and B gamma voltages corresponding to the B sub pixels. For example, the first gamma voltage generator 154 may generate the B gamma voltages corresponding to the B sub pixels during the odd-numbered horizontal periods HP1 and HP3 as the first gamma voltages VGREF1 and generate the R gamma voltages corresponding to the R sub pixels during the even-numbered horizontal periods HP2 and HP4 as the first gamma voltages VGREF1, in response to a horizontal period switch signal SWHP that toggles per horizontal period. The horizontal period switch signal SWHP may be provided from the timing controller 120 in FIG. 2. The second gamma voltage generator 155 may generate the second gamma voltages VGREF2 including G gamma voltages corresponding to the G sub pixels. As a result, the gamma voltage generation circuit 150*b* of FIG. 17A may provide the first gamma voltages VGREF1 and the second gamma voltages VGREF2 as illustrated in FIG. 6, using the two gamma voltage generators 154 and 155.

As described with reference to FIGS. 4, 5 and 6, in the zigzag connection structure ZZSTa according to some example embodiments, the two gamma voltage drivers 154 and 155, which operate independently as described with reference to FIGS. 17A and 17B, may support the normal operation mode using the data drivers as illustrated in FIG. 5. As a result, in comparison with the case of FIG. 16, one gamma voltage generator r ray be reduced in case of FIGS. 17A and 17B.

As such, the display panel and the display device including the display panel according to some example embodiments may reduce occupation area of the gamma voltage generation circuit and reduce static power consumption through the zigzag connection structure.

Figure 18A:
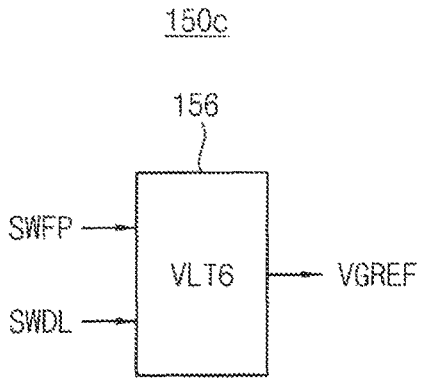
FIG. 18A is a diagram illustrating a gamma voltage generation circuit according to an example embodiment.
Figure 18B:
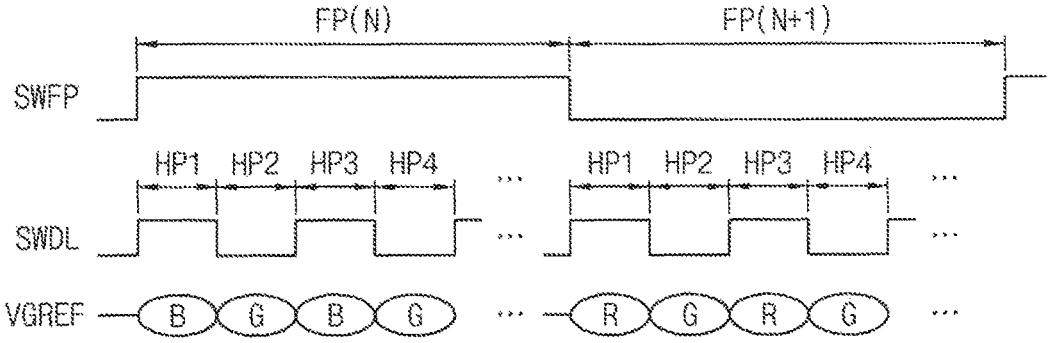
FIG. 18B is a timing diagram illustrating an operation of the gamma voltage generation circuit of FIG. 18A.

FIG. 18A is a diagram illustrating a gamma voltage generation circuit according to an example embodiment, and FIG. 18B is a timing diagram illustrating an operation of the gamma voltage generation circuit of FIG. 18A.

A gamma voltage generation circuit 150*c* of FIG. 18A includes a single gamma voltage generator (VLT6) 156.

Referring to FIGS. 18A and 18B, the gamma voltage generator 156 may selectively generate R gamma voltages corresponding to the R sub pixels, B gamma voltages corresponding to the B sub pixels and G gamma voltages corresponding to the G sub pixels. For example, the gamma voltage generator 156 may operate in response to a frame period switch signal SWFP that toggles per frame period and a horizontal period switch signal SWHP that toggles per horizontal period. The gamma voltage generator 156 may generate the B gamma voltages during the odd-numbered horizontal periods HP1 and HP3 of the N-th frame period FP(N) and the G gamma voltage during the even-numbered horizontal periods HP2 and HP4 of the N-th frame period FP(N). In addition, the gamma voltage generator 156 may generate the R gamma voltages during the odd-numbered horizontal periods HP1 and HP3 of the (N+1)-th frame period FP(N+1) and the G gamma voltage during the even-numbered horizontal periods HP2 and HP4 of the (N+1)-th frame period FP(N+1) next to the N-th frame period FP(N). The frame period switch signal SWFP and the horizontal period switch signal SWHP may be provided from the timing controller 120 in FIG. 2. As a result, the gamma voltage generation circuit 150*c* of FIG. 18A may provide the gamma voltages VGREF as illustrated in FIGS. 11 and 13, using the one gamma voltage generator 156.

As described with reference to FIGS. 4, 10, 11, and 13, in the zigzag connection structure ZZSTa according to some example embodiments, the tone gamma voltage driver 156 as described with reference to FIGS. 18A and 18B may support the interlace operation mode using the data drivers as illustrated in FIG. 10. As a result, in comparison with the case of FIG. 16, two gamma voltage generators may be reduced in case of FIGS. 18A and 18B.

As such, the display panel and the display device including the display panel according to some example embodiments may further reduce occupation area of the gamma voltage generation circuit and further reduce static power consumption through the zigzag connection structure and the interlace operation.

Figure 19:
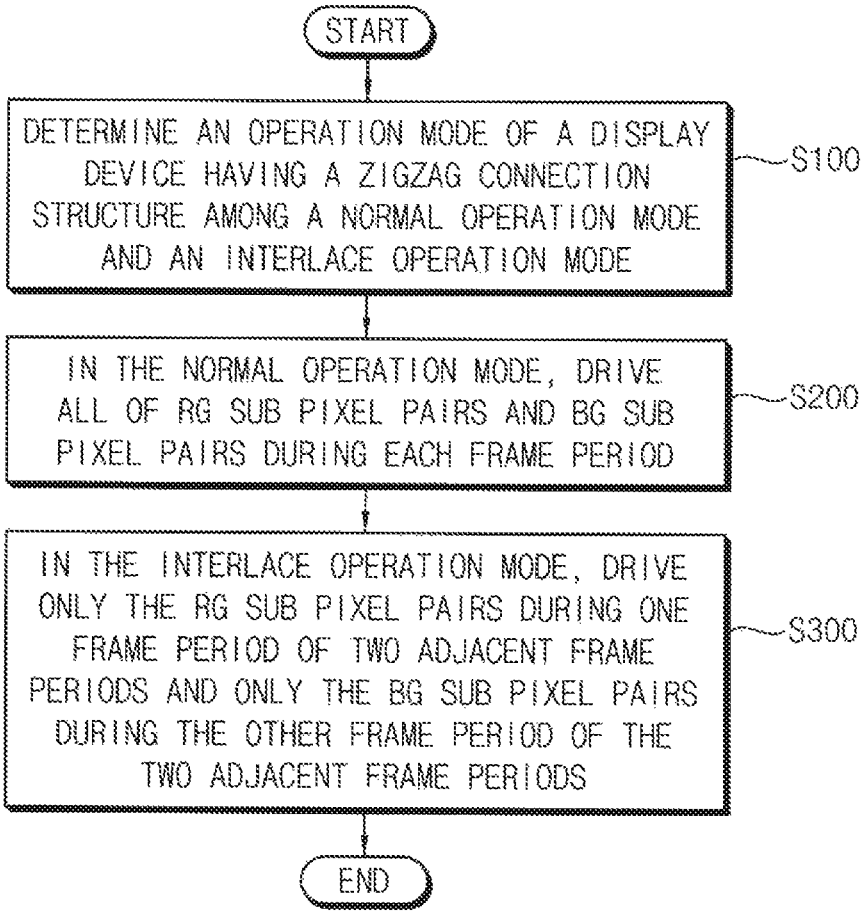
FIG. 19 is a flow chart illustrating a method of operating a display device according to an example embodiment.

FIG. 19 is a flow chart illustrating a method of operating a display device according to an example embodiment.

Referring to FIG. 19, an operation mode of a display device having a zigzag connection structure may be determined (S100). The operation mode may include a normal operation mode and an interlace operation mode as described above. In the normal operation mode, all of RG sub pixel pairs and BG sub pixel pairs are driven during each frame period (S200). In the interlace operation mode, only the RG sub pixel pairs are driven during one frame period of two adjacent frame periods and only the BG sub pixel pairs are driven during the other frame period of the two adjacent frame periods (S300).

For example, the normal operation mode may be selected when a video of high quality is displayed and the interlace operation mode may be selected when a video requiring low quality or a still image is displayed. In some example embodiments, the display device may have a flexible configuration to select and perform the normal operation mode or the interlace operation mode through the zigzag connection structure. In other example embodiments, the display device may have a fixed configuration to perform the normal operation mode or the interlace operation mode through the zigzag connection structure.

Figure 20:
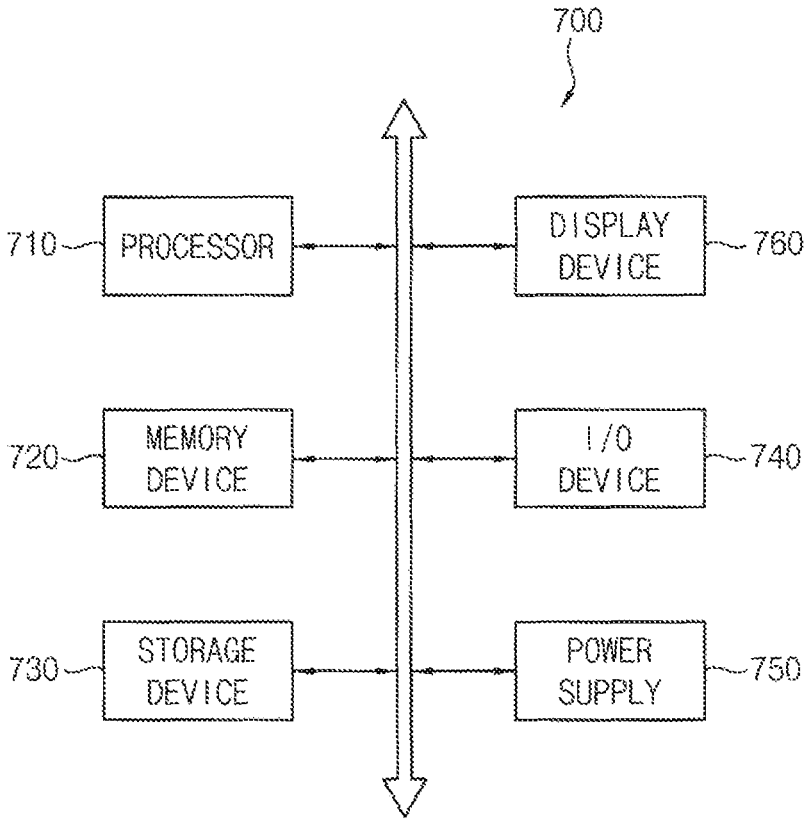
FIG. 20 is a block diagram illustrating a system according to an example embodiment.

FIG. 20 is a block diagram illustrating a system according to an example embodiment.

Referring to FIG. 20, a mobile device 700 includes a processor 710, a memory device 720, a storage device 730, an input/output (I/O) device 740, a power supply 750, and a display device 760. The mobile device 700 may further include a plurality of ports for communicating with a video card, a sound card, a memory card, a universal serial bus (USB) device, or other electronic systems.

The processor 710 may perform various computing functions or tasks. The processor 710 may be any processing unit such as a microprocessor or a central processing unit (CPU). The processor 710 may be connected to other components via an address bus, a control bus, a data bus, or the like. Further, the processor 710 may be coupled to an extended bus such as a peripheral component interconnection (PCI) bus.

The memory device 720 may store data for operations of the mobile device 700. For example, the memory device 720 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, and/or at least one volatile memory device such as a dynamic random access memory (DRAM) device, a static random access memory (SRAM) device, a mobile dynamic random access memory (mobile DRAM) device, etc.

The storage device 730 may be, for example, a solid state drive (SSD) device, a hard disk drive (HDD) device, a CD-ROM device, etc. The I/O device 740 may be, for example, an input device such as a keyboard, a keypad, a mouse, a touch screen, and/or an output device such as a printer, a speaker, etc. The power supply 750 may supply power for operating the mobile device 700. The display device 760 may communicate with other components via the buses or other communication links.

As described above with reference to FIGS. 1 through 19, the display device 760 according to some example embodiments may have a zigzag connection structure. In the zigzag connection structure, sub pixels of a first color may be connected to odd-numbered gate lines and sub pixels of a second color may be connected to even-numbered gate lines. In some example embodiments, RG sub pixel pairs included in an odd-numbered row of two adjacent rows and RG sub pixel pairs included in an even-numbered row of the two adjacent rows are alternately connected to a common gate line, and BG sub pixel pairs included in an odd-numbered row of two adjacent rows and BG sub pixel pairs included in an even-numbered row of the two adjacent rows are alternately connected to a common gate line.

As described above, the display panel and the display device including the display panel according to some example embodiments may reduce line flickering in a row direction and image degradation by interlace scanning through the zigzag connection structure in which sub pixels of the same color included in two adjacent rows are connected to the same gate line. Further, the display panel and the display device including the display panel according to some example embodiments may perform an interlace operation and reduce dynamic power consumption through the zigzag connection structure. Further, the display panel and the display device including the display panel according to some example embodiments may reduce occupation area of the gamma voltage generation circuit and reduce static power consumption through the zigzag connection structure.

The disclosed example embodiments may be applied to any device or any system including a display panel. For example, the disclosed example embodiments may be applied to a cellular phone, a smart phone, a tablet computer, a personal digital assistant (PDA), a portable multimedia player (PMP), a digital camera, a music player, a portable game console, a navigation system, a video phone, a personal computer (PC), a server computer, a workstation, a tablet computer, a laptop computer, etc.

The foregoing is illustrative of example embodiments and is not to be construed as limiting thereof. Although a few example embodiments have been described, those skilled in the art will readily appreciate that many modifications are possible in the disclosed example embodiments without materially departing from the present inventive concepts.

What is claimed is:

1. A display device comprising:

a display panel including a plurality of gate lines, a plurality of data lines and a plurality of sub pixels connected to the plurality of gate lines and the plurality of data lines, respectively, the display panel having a zigzag connection structure in which RG sub pixel pairs included in a first odd-numbered row and RG sub pixel pairs included in a first even-numbered row adjacent to the first odd-numbered row are alternately connected to a first common gate line in a row direction, and BG sub pixel pairs included in a second odd-numbered row and BG sub pixel pairs included in a second even-numbered row adjacent to the second odd-numbered row are alternately connected to a second common gate line in the row direction; and a driving circuit configured to drive the display panel, wherein the driving circuit includes a half line buffer circuit configured to delay and output data corresponding to a half of the plurality of data lines by one horizontal period.

2. The display device of claim 1, wherein the driving circuit is configured to drive one of the RG sub pixel pairs or the BG sub pixel pairs during one horizontal period.

3. The display device of claim 1, wherein the driving circuit is configured to drive the RG sub pixel pairs during a first frame period and drive the BG sub pixel pairs during a second frame period next to the first frame period in an interlace operation mode.

4. The display device of claim 1, wherein the driving circuit is configured to drive both of the RG sub pixel pairs and the BG sub pixel pairs during each frame period in a normal mode.

5. The display device of claim 1, wherein, the driving circuit is configured to drive odd-numbered gate lines during a first frame period and drive even-numbered gate lines during a second frame period next to the first frame period in an interlace operation mode.

6. The display device of claim 1, wherein the driving circuit includes:

a plurality of data drivers connected to a plurality of data lines;

a first gamma voltage generator configured to selectively generate one of R gamma voltages corresponding to R sub pixels or B gamma voltages corresponding to B sub pixels; and a second gamma voltage generator configured to generate G gamma voltages corresponding to G sub pixels.

7. The display device of claim 6, wherein the driving circuit further includes:

a switch circuit configured to control connections between each of the pitwaliky plurality of data drivers and each of the plurality of data lines and between each of odd-numbered data lines from among the plurality of data lines and each of even-numbered data lines from among the plurality of data lines, each of the even-numbered data lines being next to a corresponding one of the odd-numbered data lines.

8. The display device of claim 1, wherein the driving circuit includes:

a plurality of data drivers, each of the plurality of data drivers assigned to two adjacent data lines;

a switch circuit configured to selectively connect each of the plurality of data drivers to one of the two adjacent data lines; and a gamma voltage generator configured to selectively generate one of R gamma voltages corresponding to R sub pixels, B gamma voltages corresponding to B sub pixels, and G gamma voltages corresponding to G sub pixels.

9. The display device of claim 8, wherein the gamma voltage generator is configured to generate the R gamma voltages and the G gamma voltages in an alternate manner per horizontal period during a first frame period, and generate the B gamma voltages and the G gamma voltages in an alternate manner per horizontal period during a second frame period next to the first frame period in an interlace operation mode.

10. The display panel of claim 1, wherein the driving circuit includes:

a plurality of data drivers, each of the plurality of data drivers assigned to a corresponding pair of adjacent data lines; and a switch circuit configured to selectively connect each of the plurality of data drivers to one of the corresponding pair adjacent data lines based on a first switching signal and a second switching signal, the switching circuit including (1) a first switching element connected to one of the corresponding pair adjacent data lines and configured to be turned on in response to the first switching signal and (2) a second switching element connected to the other of the corresponding pair adjacent data lines and configured to be turned on in response to the second switching signal.

11. The display panel of claim 10, further comprising:

a timing controller configured to generate a timing control signal that includes the first switch signal and the second switch signal.

12. The display panel of claim 1, wherein the driving circuit includes:

a pair of adjacent data drivers corresponding to a pair of adjacent data lines, respectively; and a switch circuit configured to control connection between the pair of adjacent data drivers and the pair of adjacent data lines based on a first switching signal, a second switching signal, and a third switching signal, the switch circuit including a first switching element, a second switching element, and a third switching element, the first switching element configured to control a first connection between one of the pair of adjacent data drivers and one of the pair of adjacent data lines in response to the first switching signal, the second switching element configured to control a second connection between the other of the pair of adjacent data drivers and the other of the pair of adjacent data lines in response to the second switching signal, and the third switching element configured to control a third connection between the pair of adjacent data lines in response to the third switching signal.

13. A display panel comprising:

a plurality of gate lines extending in a row direction;

a plurality of data lines extending in a column direction; and a plurality of sub pixels connected to the plurality of gate lines and the plurality of data lines, respectively, in a zigzag connection structure such that RG sub pixel pairs included in a first odd-numbered row and RG sub pixel pairs included in a first even-numbered row adjacent to the first odd-numbered row are alternately connected to a first common gate line, and BG sub pixel pairs included in a second odd-numbered row and BG sub pixel pairs included in a second even-numbered row adjacent to the second odd-numbered row are alternately connected to a second common gate line, wherein the display panel is configured to delay data corresponding to a half of the plurality of data lines by one horizontal period.

14. The display panel of claim 13, wherein the display panel is configured to drive one of the RG sub pixel pairs or the BG sub pixel pairs during one horizontal period.

15. The display panel of claim 13, wherein the display panel is configured to drive the RG sub pixel pairs during a first frame period and the BG sub pixel pairs during a second frame period next to the first frame period in an interlace operation mode.

16. The display panel of claim 13, wherein the display panel is configured to drive both of the RG sub pixel pairs and the BG sub pixel pairs during each frame period in a normal mode.

17. A display panel comprising:

a plurality of gate lines extending in a row direction;

a plurality of data lines extending in a column direction;

a plurality of sub pixels connected to the plurality of gate lines and the plurality of data lines, respectively, the plurality of sub pixels having a zigzag connection structure in which (1) a plurality of RG sub pixel pairs and a plurality of BG sub pixel pairs are alternately arranged both in the row direction and in the column direction, and (2) the plurality of RG sub pixel pairs included in a first row and the plurality of RG sub pixel pairs included in a second row immediately adjacent to the first row are connected to a first common gate line, and the plurality of BG sub pixel pairs included in the second row and the plurality of BG sub pixel pairs included in a third row immediately adjacent to the second row are connected to a second common gate line; and a driving circuit configured to drive the plurality of sub pixels, wherein the driving circuit includes a half line buffer circuit configured to delay and output data corresponding to a half of the plurality of data lines by one horizontal period.

18. The display panel of claim 17, wherein a driving circuit is further configured to drive both of the plurality of RG sub pixel pairs and the plurality of BG sub pixel pairs during each frame period in a normal mode, and drive the plurality of RG sub pixel pairs during a first frame period and drive the plurality of BG sub pixel pairs during a second frame period next to the first frame period in an interlace operation mode.

19. The display panel of claim 18, wherein the driving circuit includes:

a plurality of data drivers, each of the plurality of data drivers connected to each data line;

a first gamma voltage generator configured to selectively generate one of R gamma voltages corresponding to R sub pixels or B gamma voltages corresponding to B sub pixels; and a second gamma voltage generator configured to generate G gamma voltages corresponding to G sub pixels.

20. The display panel of claim 18, wherein the driving circuit includes:

a plurality of data drivers, each of the plurality of data drivers assigned to two adjacent data lines;

a switch circuit configured to selectively connect a corresponding one of the plurality of data drivers to one of the two adjacent data lines of the plurality of data lines; and a gamma voltage generator configured to selectively generate one of R gamma voltages corresponding to R sub pixels, B gamma voltages corresponding to B sub pixels, and G gamma voltages corresponding to G sub pixels, the gamma voltage generator further configured to generate the R gamma voltages and the G gamma voltages in an alternate manner per horizontal period during a first frame period, and generate the B gamma voltages and the G gamma voltages in an alternate manner per horizontal period during a second frame period next to the first frame period in an interlace operation mode.

* * * * *